US010816913B2

(12) United States Patent
Kobayashi

(10) Patent No.: US 10,816,913 B2
(45) Date of Patent: Oct. 27, 2020

(54) DEVELOPER CONTAINER, IMAGE FORMING UNIT, AND IMAGE FORMING APPARATUS

(71) Applicant: Oki Data Corporation, Tokyo (JP)

(72) Inventor: Atsushi Kobayashi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 16/694,127

(22) Filed: Nov. 25, 2019

(65) Prior Publication Data

US 2020/0249592 A1 Aug. 6, 2020

(30) Foreign Application Priority Data

Jan. 31, 2019 (JP) ..... 2019-015420

(51) Int. Cl.
*G03G 15/08* (2006.01)

(52) U.S. Cl.
CPC . *G03G 15/0886* (2013.01); *G03G 2215/0692* (2013.01)

(58) Field of Classification Search
CPC ..... G03G 15/0886; G03G 2215/0692
See application file for complete search history.

(56) References Cited

U.S. PATENT DOCUMENTS

2012/0132559 A1* 5/2012 Okuma ..... G03G 15/0886 206/524.1
2013/0243491 A1* 9/2013 Nodera ..... G03G 15/0886 399/260
2014/0321885 A1* 10/2014 Fujimori ..... G03G 15/0886 399/258
2017/0060029 A1* 3/2017 Yomoda ..... G03G 15/0886

FOREIGN PATENT DOCUMENTS

JP 2017-026987 A 2/2017

* cited by examiner

*Primary Examiner* — Sophia S Chen
(74) *Attorney, Agent, or Firm* — Rabin & Berdo, P.C.

(57) ABSTRACT

A developer container includes a body and a shutter member. The body has an opening and a containing part. The containing part is to contain a developer put into the containing part through the opening. The shutter member includes a tip portion in a first direction. The shutter member is slidable between a closing position at which the shutter member closes the opening and an open position at which the shutter member leaves the opening open. The shutter member slides in the first direction and thereby moves from the open position to the closing position. The tip portion includes a top surface and a pair of side surfaces. The top surface has inclination that causes a distance in a third direction from the opening to the top surface to decrease in a second direction. Spacing in a fourth direction between the side surfaces is narrowed in the second direction.

8 Claims, 17 Drawing Sheets

DEVELOPER CONTAINER, IMAGE FORMING UNIT, AND IMAGE FORMING APPARATUS

CROSS REFERENCE TO RELATED APPLICATIONS

The present application claims priority from Japanese Patent Application No. 2019-015420 filed on Jan. 31, 2019, the entire contents of which are hereby incorporated by reference.

BACKGROUND

The technology relates to a developer container, an image forming unit, and an image forming apparatus.

The present applicant has proposed an image forming unit and an image forming apparatus that each form an image with use of a developer fed from a container that contains the developer, for example, as disclosed in Japanese Unexamined Patent Application Publication No. 2017-26987.

SUMMARY

Some image forming apparatuses that form an image with use of a developer fed from a container has a replaceable image forming unit. The image forming unit has an opening through which a developer is to be put in. Upon replacement of the image forming unit, a shutter member slides and thereby closes the opening. One reason for this is to prevent the developer remaining inside the image forming unit from scattering to outside of the image forming unit.

When the shutter member slides and thereby closes the opening, the developer present in vicinity of the opening can be pushed to the outside of a container by the sliding shutter, which can cause the developer to leak to outside of the container. In this case, the developer can contaminate a portion such as an outer surface of the container or a portion around the image forming unit.

It is desirable to provide a developer container that is able to prevent a developer from leaking to outside of the developer container and has superior usability.

According to one embodiment of the technology, there is provided a developer container that includes a body and a shutter member. The body has an opening and a containing part. The containing part is to contain a developer put into the containing part through the opening. The shutter member includes a tip portion at a tip of the shutter member in a first direction. The shutter member is slidable between a closing position at which the shutter member closes the opening and an open position at which the shutter member leaves the opening open. The shutter member slides in the first direction and thereby moves from the open position to the closing position. The tip portion includes a top surface and a pair of side surfaces. The top surface has inclination. The top surface has a distance in a third direction from the opening to the top surface. The inclination causes the distance to decrease in a second direction. The second direction is opposite to the first direction. The third direction is a direction from outer side of the body toward inner side of the body. Spacing in a fourth direction between the pair of side surfaces is narrowed in the second direction. The fourth direction is substantially perpendicular to each of the first direction and the third direction.

According to one embodiment of the technology, there is provided an image forming unit that includes a developer container. The developer container includes a body and a shutter member. The body has an opening and a containing part. The containing part is to contain a developer put into the containing part through the opening. The shutter member includes a tip portion at a tip of the shutter member in a first direction. The shutter member is slidable between a closing position at which the shutter member closes the opening and an open position at which the shutter member leaves the opening open. The shutter member slides in the first direction and thereby moves from the open position to the closing position. The tip portion includes a top surface and a pair of side surfaces. The top surface has inclination. The top surface has a distance in a third direction from the opening to the top surface. The inclination causes the distance to decrease in a second direction. The second direction is opposite to the first direction. The third direction is a direction from outer side of the body toward inner side of the body. Spacing in a fourth direction between the pair of side surfaces is narrowed in the second direction. The fourth direction is substantially perpendicular to each of the first direction and the third direction.

According to one embodiment of the technology, there is provided an image forming apparatus that includes a developer container. The developer container includes a body and a shutter member. The body has an opening and a containing part. The containing part is to contain a developer put into the containing part through the opening. The shutter member includes a tip portion at a tip of the shutter member in a first direction. The shutter member is slidable between a closing position at which the shutter member closes the opening and an open position at which the shutter member leaves the opening open. The shutter member slides in the first direction and thereby moves from the open position to the closing position. The tip portion includes a top surface and a pair of side surfaces. The top surface has inclination. The top surface has a distance in a third direction from the opening to the top surface. The inclination causes the distance to decrease in a second direction. The second direction is opposite to the first direction. The third direction is a direction from outer side of the body toward inner side of the body. Spacing in a fourth direction between the pair of side surfaces is narrowed in the second direction. The fourth direction is substantially perpendicular to each of the first direction and the third direction.

DETAILED DESCRIPTION

Figure 1:
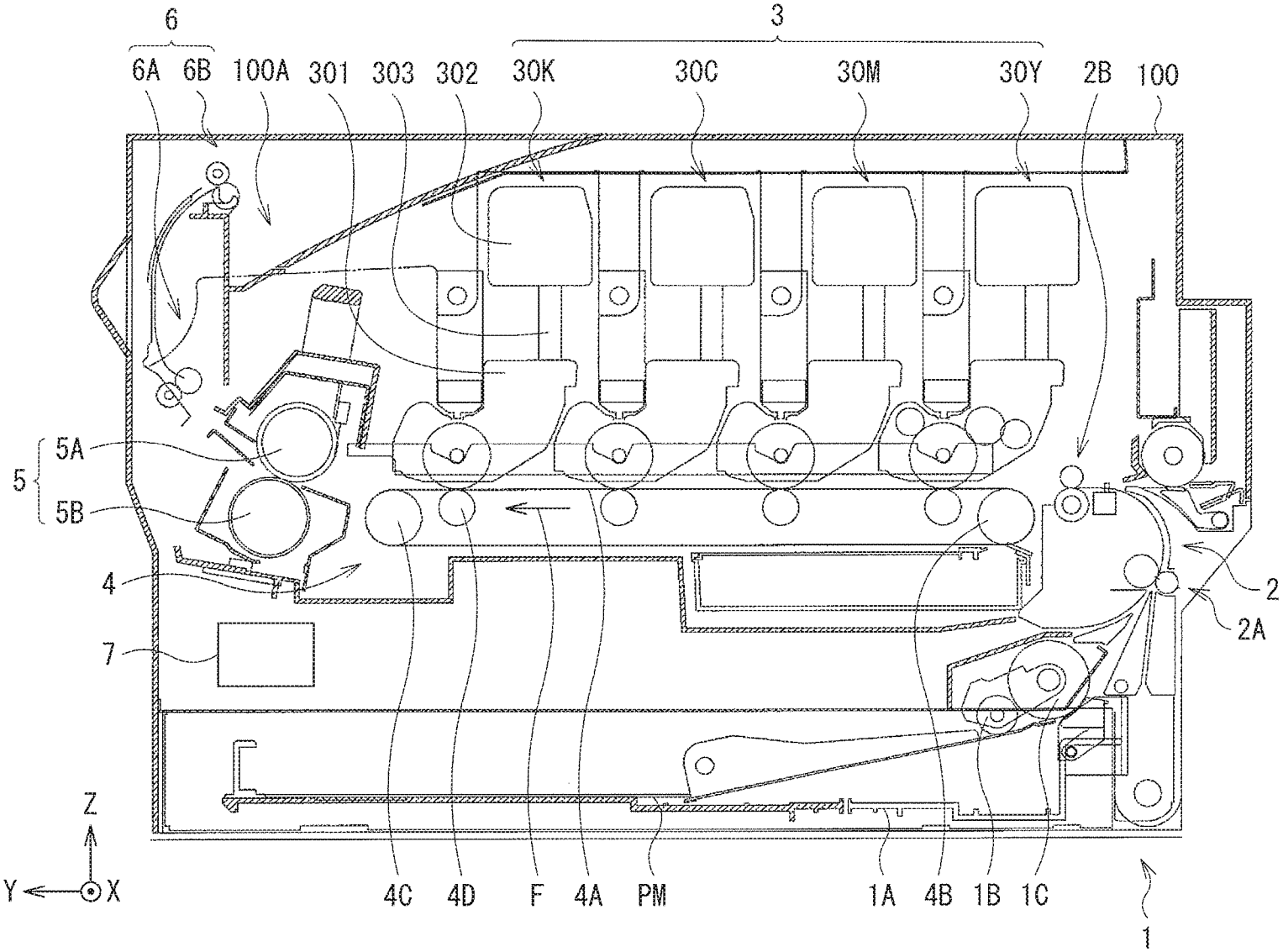
FIG. 1 is a schematic diagram illustrating an example of a general configuration of an image forming apparatus according to an example embodiment of the technology.

Hereinafter, some example embodiments of the technology will be described in detail with reference to the drawings. Note that the following description is directed to illustrative examples of the technology and not to be construed as limiting to the technology. Factors including, without limitation, numerical values, shapes, materials, components, positions of the components, and how the components are coupled to each other are illustrative only and not to be construed as limiting to the technology. Further, elements in the following example embodiments which are not recited in a most-generic independent claim of the technology are optional and may be provided on an as-needed basis. The drawings are schematic and are not intended to be drawn to scale. Note that the like elements are denoted with the same reference numerals, and any redundant description thereof will not be described in detail.

1. Example Embodiment

[Configuration of Image Forming Apparatus]

FIG. 1 schematically illustrates an example of a general configuration of an image forming apparatus according to an example embodiment of the technology. The image forming apparatus may correspond to an "image forming apparatus" in one specific but non-limiting embodiment of the technology. The image forming apparatus may be, for example but not limited to, a printer that forms an image such as a color image by an electrophotographic method on a print medium PM on which printing is to be performed. Non-limiting examples of the print medium PM may include a sheet of paper and a film. The image forming apparatus may include, inside a housing 100, a print medium feeding section 1, a conveying section 2, an image forming section 3, a transfer section 4, a fixing section 5, a discharging section 6, and a controller 7. The controller 7 may control operation of each of the print medium feeding section 1, the conveying section 2, the image forming section 3, the transfer section 4, the fixing section 5, and the discharging section 6. As used herein, a path along which the print medium PM is to be conveyed is referred to as a "conveyance path." A direction toward the print medium feeding section 1 from any component or a position closer to the print medium feeding section 1 than the component is referred to by a term "upstream" on the conveyance path. A direction opposite to the direction toward the print medium feeding section 1 from any component or a position farther from the print medium feeding section 1 than the component is referred to by a term "downstream" on the conveyance path. A direction in which the print medium PM travels on the conveyance path, i.e., a direction from upstream side toward downstream side on the conveyance path, is referred to as a "conveyance direction F." A direction that is parallel to the print medium PM conveyed along the conveyance path and is perpendicular to the conveyance direction F is referred to as a "width direction." The width direction may be an X-axis direction illustrated in FIG. 1, for example. A dimension in the conveyance direction F is referred to as a "length." A dimension in the width direction is referred to as a "width."

[Print Medium Feeding Section 1]

The print medium feeding section 1 may feed the print medium PM one by one toward the conveying section 2. The print medium feeding section 1 may include, for example but not limited to, a tray 1A, a pickup roller 1B, and a feeding roller 1C. The tray 1A may contain a plurality of print media PM in a stacked state. The tray 1A may be detachably attached to a lower portion of the image forming apparatus. The pickup roller 1B and the feeding roller 1C may sequentially feed the print media PM contained in the tray 1A to the conveyance path leading to the conveying section 2. The pickup roller 1B and the feeding roller 1C may rotate in a direction in which the print medium PM is fed to downstream side toward the conveying section 2, under control of the controller 7. The pickup roller 1B may be disposed at a position at which the pickup roller 1B is allowed to come into contact with an upper surface of the print medium PM on the top of the stack. The feeding roller 1C may be disposed downstream of the pickup roller 1B.

[Conveying Section 2]

The conveying section 2 may receive the print medium PM from the print medium feeding section 1 and convey the print medium PM toward the transfer section 4 while controlling a skew of the print medium PM. The conveying section 2 may include, for example but not limited to, two pairs of registration rollers, i.e., a pair of registration rollers 2A and a pair of registration rollers 2B.

[Image Forming Section 3]

The image forming section 3 may form a toner image IMG on the print medium PM conveyed from the conveying section 2. The toner image IMG will be described later with reference to FIG. 2. As illustrated in FIG. 1, the image forming section 3 may include, for example, four image forming units, i.e., image forming units 30Y, 30M, 30C, and 30K. The image forming units 30Y, 30M, 30C, and 30K may each form the toner image IMG of a corresponding color with use of a toner T of the corresponding color. For example, the image forming units 30Y, 30M, 30C, and 30K may form the toner images IMG of yellow, magenta, cyan, and black with use of a yellow toner, a magenta toner, a cyan toner, and a black toner, respectively. For example, the image forming units 30 may be disposed in order of the image forming unit 30Y, the image forming unit 30M, the image forming unit 30C, and the image forming unit 30K in the conveyance direction F. Herein, the four image forming units 30Y, 30M, 30C, and 30K are collectively referred to as the image forming unit 30 in a case where the four image forming units 30Y, 30M, 30C, and 30K are not distinguished from each other. Each of the image forming units 30 may include, for example but not limited to, a body portion 301, a toner cartridge 302, and a toner conveyance path 303. The toner cartridge 302 may be provided above the body portion 301. The toner conveyance path 303 may couple the body portion 301 and the toner cartridge 302 to each other. The toner cartridge 302 may contain the toner T. The body portion 301 may form an image with use of the toner T fed from the toner cartridge 302. The toner cartridge 302 may be a provided separately from the body portion 301 and the toner conveyance path 303 that are disposed below the toner cartridge 302. The toner cartridge 302 may be attachable to and detachable from the body portion 301 and the toner conveyance path 303. In one example embodiment, the body portion 301, the toner cartridge 302, and the toner conveyance path 303 may be provided as an integrated member. The image forming unit 30 may correspond to an "image forming unit" in one specific but non-limiting embodiment of the technology. The toner T may correspond to a "developer" in one specific but non-limiting embodiment of the technology.

Figure 2:
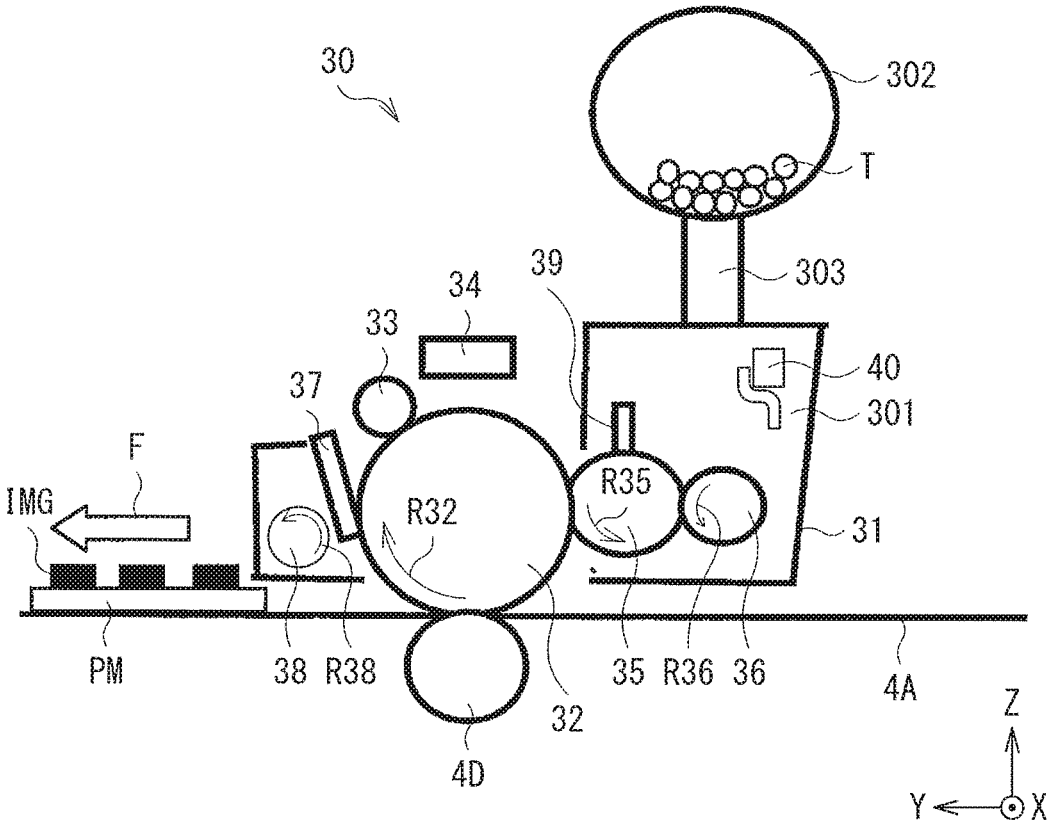
FIG. 2 is a schematic diagram illustrating an example of an inner configuration of an image forming unit illustrated in FIG. 1.

FIG. 2 illustrates an outline configuration of the body portion 301, the toner cartridge 302, and the toner conveyance path 303. FIG. 2 also illustrates some components of the transfer section 4. The body portion 301 may include, for example but not limited to, a cover 31. The body portion 301 may include a photosensitive drum 32, a charging roller 33, a developing roller 35, a feeding roller 36, a cleaning blade 37, a waste toner conveying spiral 38, a doctor blade 39, and a remaining toner sensor 40 that are surrounded by the cover 31. The body portion 301 may further include an exposure head 34 that is so provided as to be able to perform exposure on the photosensitive drum 32 from outside of the cover 31. The exposure head 34 may include, for example but not limited to, a light-emitting diode (LED.) The body portion 301 of the image forming unit 30 will be described in detail later.

[Transfer Section 4]

The transfer section 4 may also be referred to as a transfer belt unit. The transfer section 4 may include a transfer belt 4A, a driving roller 4B, an idler roller 4C, and a transfer roller 4D. The driving roller 4B may drive the transfer belt 4A. The idler roller 4C may be a driven roller. The transfer roller 4D may be opposed to the photosensitive drum 32 with the transfer belt 4A in between. Each of the driving roller 4B and the idler roller 4C may be a substantially-columnar member that is rotatable about a rotational axis. The rotational axis may extend in a width direction. The transfer section 4 may convey the print medium PM, conveyed from the conveying section 2, in the conveyance direction F. The transfer section 4 may sequentially transfer, onto a surface of the print medium PM, the toner images IMG formed by the respective image forming units 30Y, 30M, 30C, and 30K.

The transfer belt 4A may be an endless elastic belt including a resin material such as polyimide resin, for example. The transfer belt 4A may lie on the driving roller 4B and the idler roller 4C while being stretched. Being controlled by the controller 7, the driving roller 4B may be driven to rotate in a direction in which the print medium PM is conveyed in the conveyance direction F, and thereby cause the transfer belt 4A to rotate circularly. The driving roller 4B may be disposed upstream of the image forming units 30Y, 30M, 30C, and 30K. The idler roller 4C may adjust tension applied to the transfer belt 4A by biasing force of a biasing member. The idler roller 4C may rotate in the same direction as that of the driving roller 4B. The idler roller 4C may be disposed downstream of the image forming units 30Y, 30M, 30C, and 30K.

The transfer roller 4D may be directed to electrostatically transferring, onto the print medium PM, the toner images IMG formed by the respective image forming units 30Y, 30M, 30C, and 30K while conveying the print medium PM in the conveyance direction F by rotating in a direction opposite to the rotation direction of the photosensitive drum 32. The transfer roller 4D may include, for example, a foamable electrically-semiconductive elastic rubber material.

[Fixing Section 5]

The fixing section 5 may be directed to fixing the toner image IMG to the print medium PM by applying heat and pressure to the toner image IMG transferred onto the print medium PM which has passed through the transfer section 4. The fixing section 5 may include, for example but not limited to, an upper roller 5A and a lower roller 5B.

Each of the upper roller 5A and the lower roller 5B may include a built-in heat source. The heat source may be a heater such as a halogen lamp, for example. Each of the upper roller 5A and the lower roller 5B may thereby serve as a heating roller that applies heat to the toner image IMG on the print medium PM. Being controlled by the controller 7, the upper roller 5A may rotate in the direction in which the print medium PM is conveyed in the conveyance direction F. The heat source in each of the upper roller 5A and the lower roller 5B may receive a bias voltage controlled by the controller 7 and thereby control a surface temperature of the corresponding one of the upper roller 5A and the lower roller 5B. The lower roller 5B may be so opposed to the upper roller 5A that a contact portion is provided between the upper roller 5A and the lower roller 5B. The lower roller 5B may thereby serve as a pressure-applying roller that applies pressure to the toner image IMG on the print medium PM. In one example embodiment, the lower roller 5B may include a surface layer including an elastic material.

[Discharging Section 6]

The discharging section 6 may discharge, to outside, the print medium PM on which the toner image IMG has been fixed by the fixing section 5. The discharging section 6 may include, for example but not limited to, a conveying roller 6A and a conveying roller 6B. The conveying rollers 6A and 6B may discharge the print medium PM to the outside via the conveying path and store the print medium PM in a stacker 100A provided outside. Being controlled by the controller 7, the conveying rollers 6A and 6B may rotate in the direction in which the print medium PM is conveyed in the conveyance direction F.

[Configuration of Body Portion 301]

Referring to FIGS. 3 to 5E, description is given below of a detailed configuration of the body portion 301 of the image forming unit 30.

Figure 3:
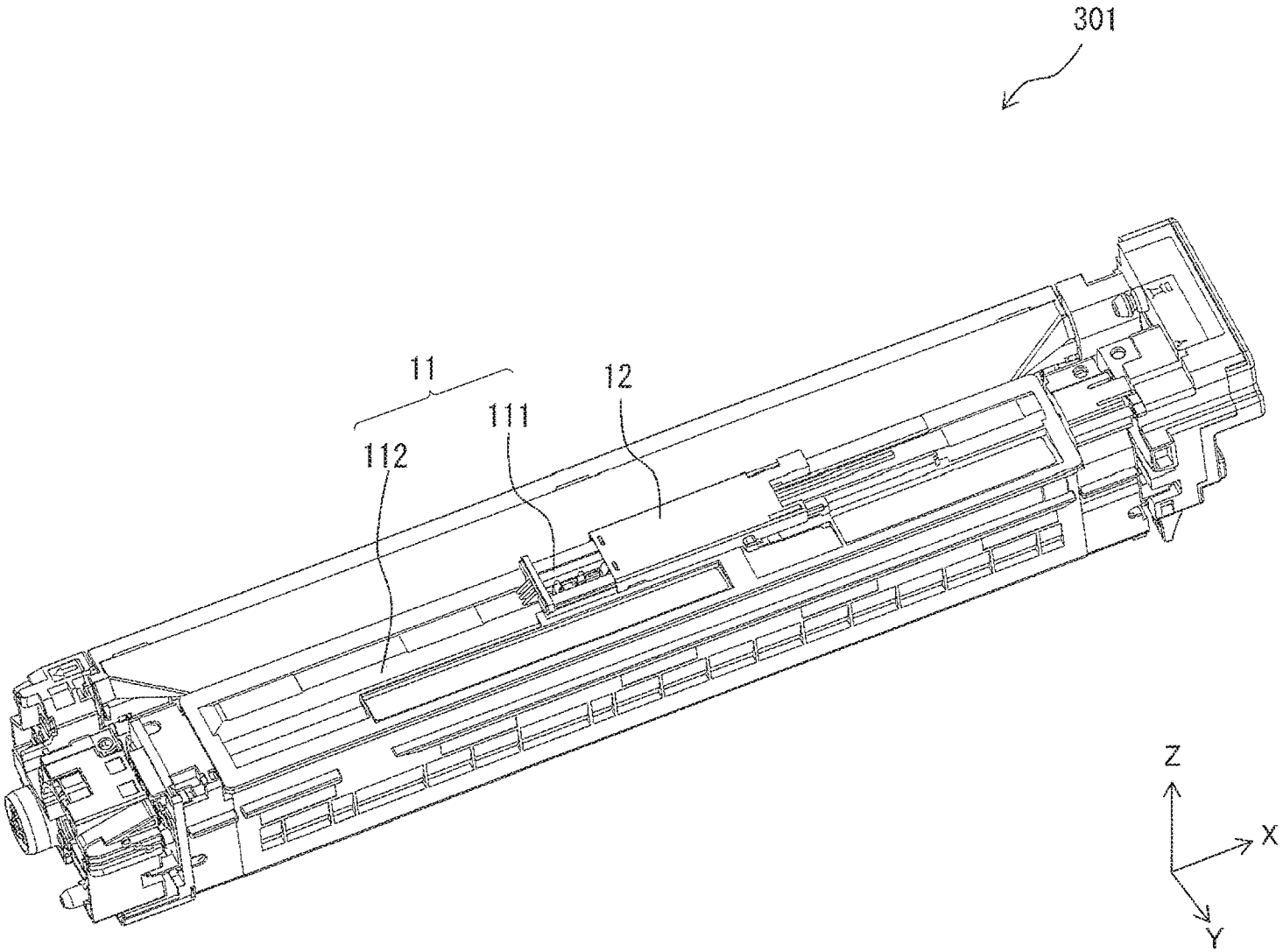
FIG. 3 is a perspective view of an example of an appearance configuration of a body portion of the image forming unit illustrated in FIG. 1.

FIG. 3 is a perspective view of an appearance of the body portion 301 as a whole. The body portion 301 includes a body 11 and a shutter 12, as illustrated in FIG. 3. The body 11 has an input opening 111 and a containing portion 112. The input opening 111 may be an opening through which the toner T is to be put in from the toner cartridge 302 via the toner conveyance path 303, for example. The containing portion 112 is to contain the toner T put in through the input opening 111. The shutter 12 may be so provided to an upper portion of the body 11 as to be reversibly movable in the width direction, i.e., the X-axis direction. The shutter 12 may be able to move between a "closing position" and an "open position" by moving in the width direction, i.e., the X-axis direction. The shutter 12 may close the input opening 111 when the shutter 12 is at the closing position and leave the input opening 111 open when the shutter 12 is at the open position. The image forming unit 30 may be so mounted in the housing 100 of the image forming apparatus so that the input opening 111 of the body 11 is directed upward in a vertical direction, i.e., a gravitational direction, for example. That is, the toner T falling from the toner cartridge 302 above via the toner conveyance path 303 may be put into the containing portion 112 through the input opening 111 in the image forming apparatus.

The body portion 301 may correspond to a "developer container" in one specific but non-limiting embodiment of the technology. The body 11 may correspond to a "body" in one specific but non-limiting embodiment of the technology. The input opening 111 may correspond to an "opening" in one specific but non-limiting embodiment of the technology. The containing portion 112 may correspond to a "containing portion" in one specific but non-limiting embodiment of the technology. The shutter 12 may correspond to a "shutter member" in one specific but non-limiting embodiment of the technology.

Figure 4A:
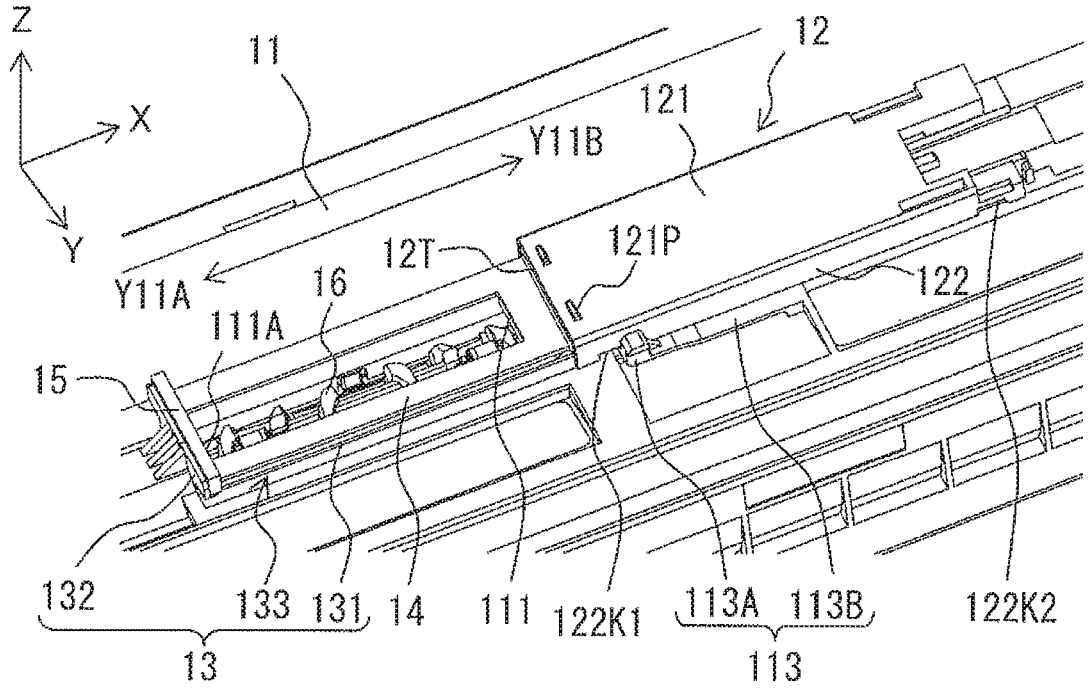
FIG. 4A is a first perspective view in an enlarged manner of a main part of the body portion of the image forming unit illustrated in FIG. 1.
Figure 4B:
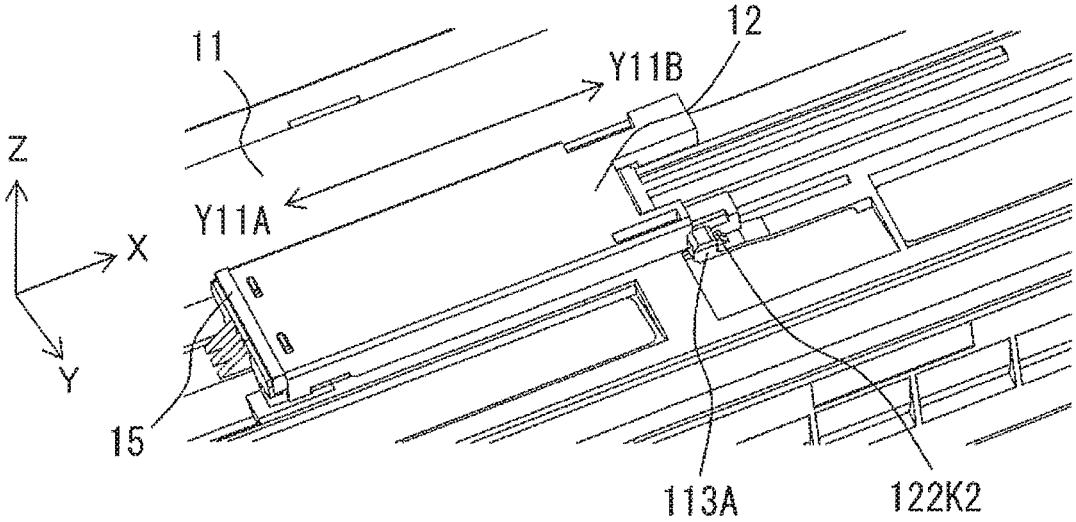
FIG. 4B is a second perspective view in an enlarged manner of the main part of the body portion of the image forming unit illustrated in FIG. 1.
Figure 4C:
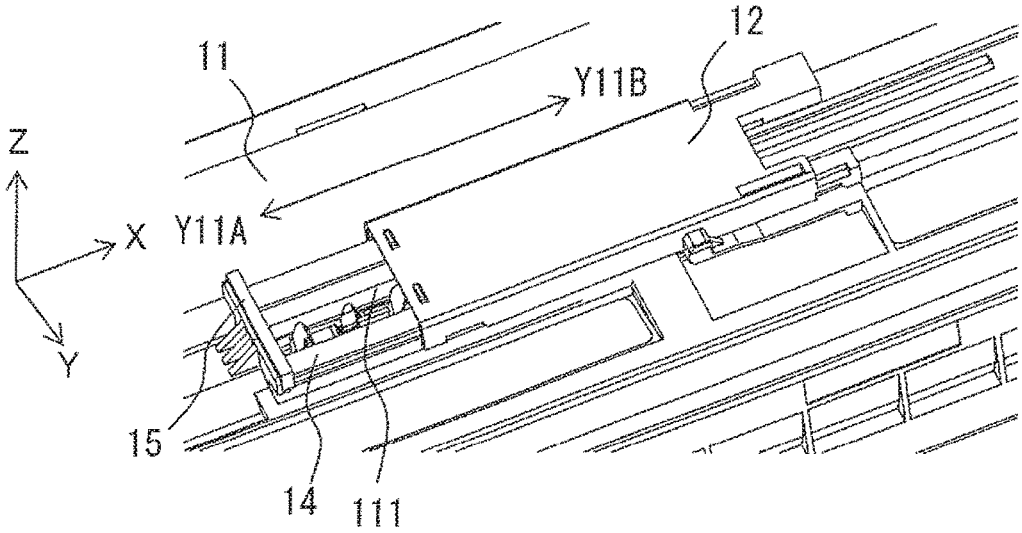
FIG. 4C is a third perspective view in an enlarged manner of the main part of the body portion of the image forming unit illustrated in FIG. 1.

FIGS. 4A to 4C each illustrate, in an enlarged manner, the vicinity of the shutter 12 of the body portion 301 illustrated in FIG. 3. FIG. 4A illustrates a case where the shutter 12 is at the "open position." FIG. 4B illustrates a case where the shutter 12 is at the "closing position." FIG. 4C illustrates a case where the shutter 12 is at a "middle position", i.e., a case where the shutter 12 is in the middle of the position moving from the "open position" to the "closing position" or in the middle of the position moving from the "closing position" to the "open position."

[Body 11]

The body 11 may be provided with a flange 13 surrounding the input opening 111 on an outer surface of the body 11. The flange 13 may include a first portion 131 and a second portion 132. The second portion 132 may be a wall that stands on the outer surface of the body 11 and be opposed to a tip surface 12T of the shutter 12 at the closing position. The tip surface 12T will be described later with reference to FIG. 4A. The first portion 131 may be provided in a region other than a region provided with the second portion 132, in the region surrounding the input opening 111. A portion of the first portion 131 may be provided with guide grooves 133. The guide groove 133 may extend in the X-axis direction. The guide grooves 133 may be provided on both sides of the input opening 111 in the Y-axis direction.

A sealing portion 14 may be provided on the first portion 131, and include a projection 16. The second portion 132 may be provided with a sealing portion 15. The sealing portion 15 may stand in the vicinity of an edge 111A, of the input opening 111, in a first direction Y11A and may come into contact with the tip surface 12T of the shutter 12 positioned at the closing position. In one example embodiment, a height position of an upper end of the sealing portion 15 may be higher than a height position of an upper end of the sealing portion 14. Each of the sealing portion 14 and the sealing portion 15 may include an elastic member having elasticity. Non-limiting examples of the elastic member may include rubber and a sponge. The sealing portion 14 and the sealing portion 15 may surround the input opening 111 without any gap. The shutter 12 may slide in the first direction Y11A with the sealing portion 14 being compressed by the shutter 12. Further, the sealing portion 15 may come into contact with the tip surface 12T of the shutter 12. This allows the input opening 111 of the body 11 to be sealed by the shutter 12 without any gap. The sealing portion 14 may correspond to an "elastic member" in one specific but non-limiting embodiment of the present technology. The sealing portion 15 may correspond to a "contact portion" in one specific but non-limiting embodiment of the present technology.

An upper surface of the body 11 may be provided with a locking lever 113 that includes a locking portion 113A and a spring portion 113B. The locking portion 113A may engage with notches 122K1 and 122K2 of the shutter 12. The spring portion 113B may bias the shutter 12 upward, i.e., in a +Z direction. The notches 122K1 and 122K2 will be described later.

[Shutter 12]

The shutter 12 positioned at the open position illustrated in FIG. 4A may slide in the first direction Y11A with respect to the body 11, and thereby move to the closing position illustrated in FIG. 4B via the middle position illustrated in FIG. 4C. The first direction Y11A may be along the X-axis direction and is indicated by an arrow in FIG. 4A. The shutter 12 positioned at the closing position illustrated in FIG. 4B may slide in a second direction Y11B with respect to the body 11, and thereby move to the open position illustrated in FIG. 4A via the middle position illustrated in FIG. 4C. The second direction Y11B may be along the X-axis direction and is indicated by an arrow in FIG. 4B. That is, the input opening 111 may be closed by the shutter 12 when the shutter 12 is at the farthest position in the first direction Y11A as illustrated in FIG. 4B. The entire input opening 111 may be exposed when the shutter 12 is at the farthest position in the second direction Y11B as illustrated in FIG. 4A.

Figure 5A:
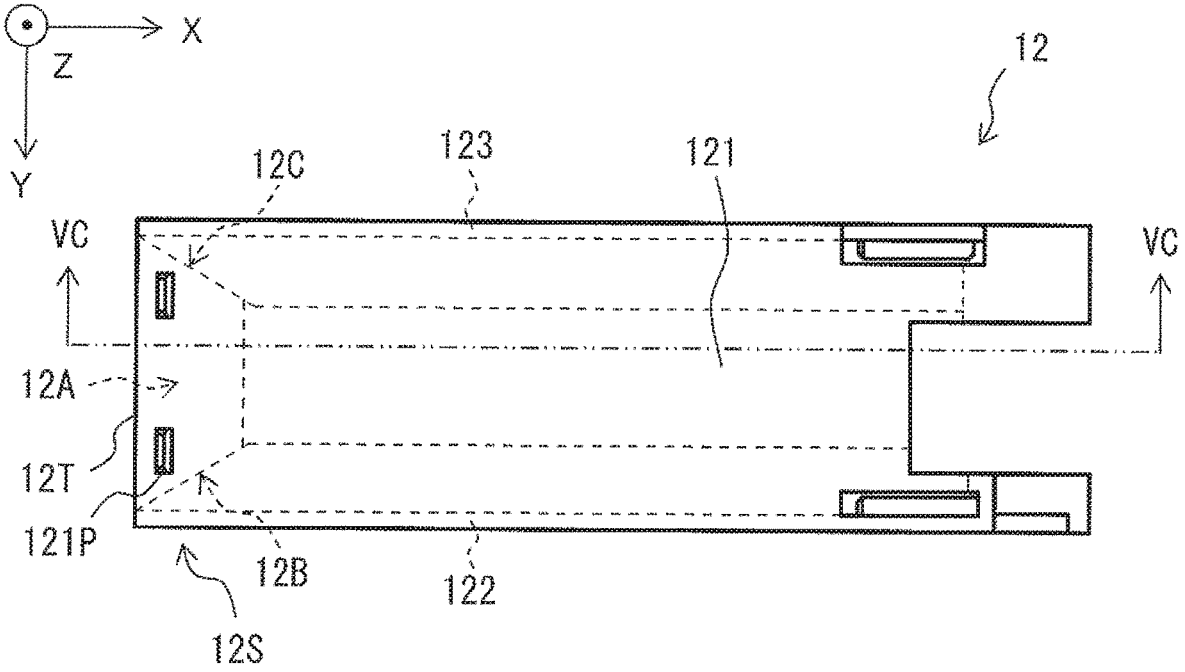
FIG. 5A is a top view of an example of an appearance of a shutter illustrated in FIG. 3.
Figure 5B:
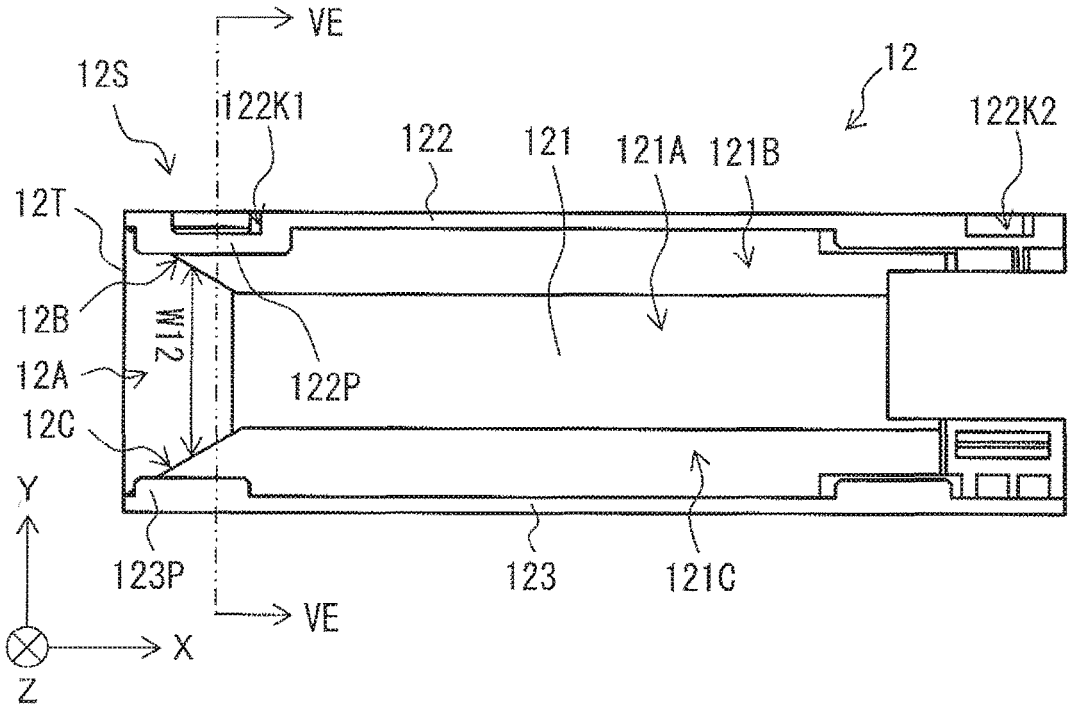
FIG. 5B is a bottom view of an example of the appearance of the shutter illustrated in FIG. 3.
Figure 5C:
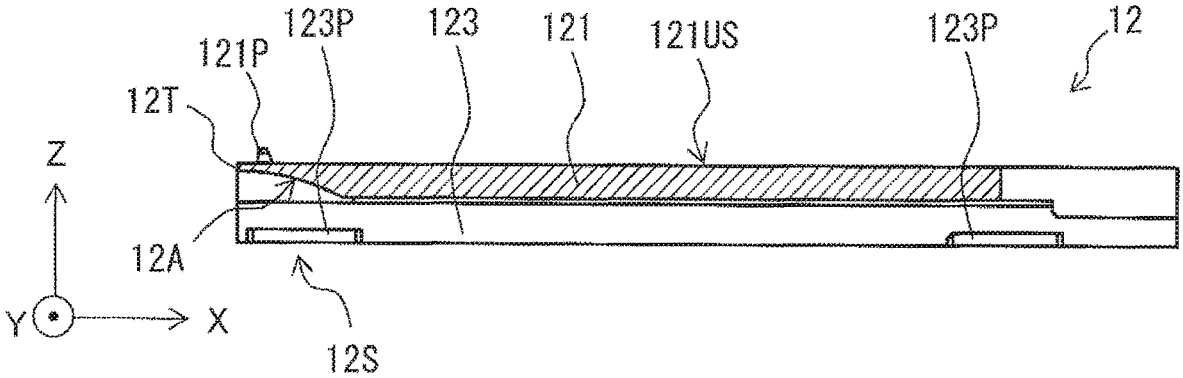
FIG. 5C is a first cross-sectional view of an example of a cross-sectional configuration of the shutter illustrated in FIG. 3.
Figure 5D:
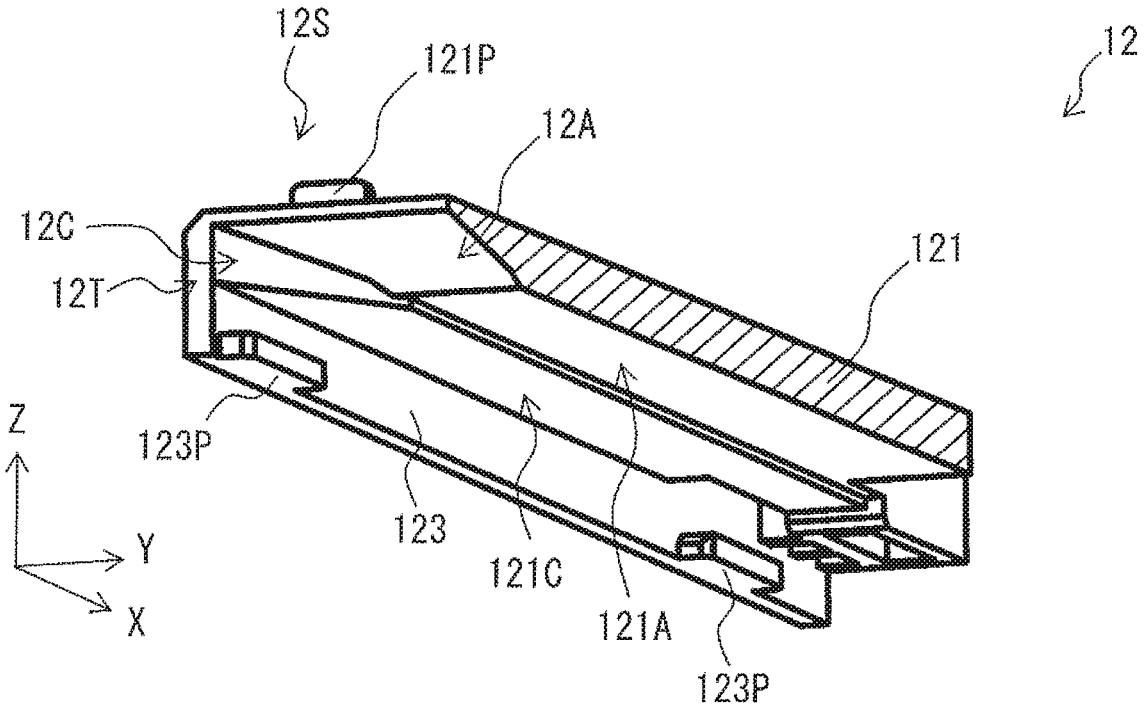
FIG. 5D is a cutaway perspective view of an example of a portion of the shutter illustrated in FIG. 3.
Figure 5E:
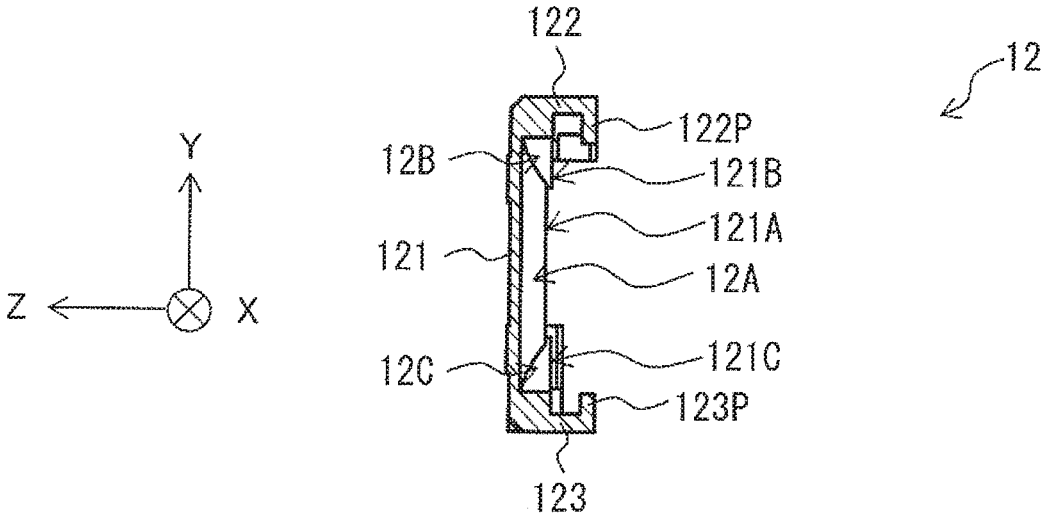
FIG. 5E is a second cross-sectional view of an example of the cross-sectional configuration of the shutter illustrated in FIG. 3.

FIGS. 5A to 5E each illustrate a detailed configuration of the shutter 12. Specifically, FIG. 5A is a top view of the shutter 12 as viewed from opposite side to the body 11. FIG. 5B is a bottom view of the shutter 12 as viewed from the body 11 side. FIG. 5C is a cross-sectional view of the shutter 12 taken along a line VC-VC and viewed from a direction indicated by arrows in FIG. 5A. FIG. 5D is a cutaway perspective view of a portion of the shutter 12. FIG. 5E is a cross-sectional view of the shutter 12 taken along a line VE-VE and viewed from a direction indicated by arrows in FIG. 5B.

As illustrated in FIGS. 5A to 5E, the shutter 12 may include a flat plate portion 121 and a pair of side wall portions 122 and 123. The flat plate portion 121 may have a plate shape that extends along an X-Y plane in which the input opening 111 extends. The pair of side wall portions 122 and 123 may stand at respective ends of the flat plate portion 121 in the Y-axis direction. That is, as illustrated in FIG. 5E, the flat plate portion 121 and the pair of side wall portions 122 and 123 may provide a substantial U-shape in a Y-Z cross-section perpendicular to the X-axis direction in which the shutter 12 moves.

A tip portion 12S in the first direction Y11A of the shutter 12 includes a top surface 12A and a pair of side surfaces 12B and 12C. The tip portion 12S described above may refer to an end in the X-axis direction that is opposed to the second portion 132 of the flange 13 and includes a tip surface 12T. The tip surface 12T may come into contact with the sealing portion 15. The top surface 12A has inclination in a third direction. The inclination of the top surface 12A increases in the second direction Y11B. The third direction is a direction from the outside of the body 11 toward the inside of the body 11 and may correspond to −Z direction. The second direction Y11B is opposite to the first direction Y11A and is illustrated in FIG. 4A to 4C. A thickness of the tip portion 12S of the shutter 12 may be therefore smaller than a thickness of a portion, of the shutter 12, other than the tip portion 12S. As illustrated in FIGS. 5C and 5D, the top surface 12A may be a recessed surface that is recessed toward the containing portion 112, for example. The top surface 12A may be a flat surface or may be a protruding surface that protrudes toward the containing portion 112.

The pair of side surfaces 12B and 12C may each be parallel to a vertical direction, i.e., a Z-axis direction, and intersect with the top surface 12A, for example. In the X-Y plane, the pair of side surfaces 12B and 12C may each be inclined in both the X-axis direction and the Y-axis direction. That is, the pair of side surfaces 12B and 12C may be so inclined that spacing W12 in a fourth direction decreases in the second direction Y11B away from the tip surface 12T. The fourth direction may be perpendicular to both the X-axis direction and the Z-axis direction, and may correspond to the width direction, i.e., the Y-axis direction. The second direction Y11B may correspond to the +X direction.

A protrusion 121P may be provided on an upper surface 121US, illustrated in FIG. 5C, of the flat plate portion 121 of the tip portion 12S. An inner surface of the flat plate portion 121, i.e., a surface on the opposite side to the upper surface 121US, may include three portions, i.e., a portion 121A, a portion 121B, and a portion 121C. The portion 121B may be a surface that extends in the X-axis direction along the side wall portion 122. The portion 121C may be a surface that extends in the X-axis direction along the side wall portion 123. The portion 121A may be a surface provided between the portion 121B and the portion 121C in the Y-axis direction. The portion 121B and the portion 121C may come into close contact with the sealing portion 14. A protrusion 122P may be provided on an inner surface of the side wall portion 122. A protrusion 123P may be provided on an inner surface of the side wall portion 123. The protrusions 122P and 123P may each engage with corresponding one of the pair of guide grooves 133 provided in the first portion 131. This allows guiding of the protrusions 122P and 123P by the pair of guide grooves 133 to cause the shutter 12 to slide in the X-axis direction.

The notches 122K1 and 122K2 to engage with the locking portion 113A may be provided at a lower portion of the tip portion 12S of the side wall portion 122. The notch 122K1 may be provided at a position that allows the notch 122K1 to engage with the locking portion 113A when the shutter 12 is in the open state. The notch 122K2 may be provided at a position that allows the notch 122K2 to engage with the locking portion 113A when the shutter 12 is in the closed state.

Description is given next of components inside the body portion 301 with reference to FIG. 2.

The photosensitive drum 32 may be a columnar member capable of carrying an electrostatic latent image on a surface, i.e., a superficial portion thereof. The photosensitive drum 32 may include a photoreceptor, e.g., an organic photoreceptor. In a specific but non-limiting example, the photosensitive drum 32 may include an electrically-conductive support and a photoconductive layer. The photoconductive layer may cover an outer periphery, i.e., a surface, of the electrically-conductive support. The electrically-conductive support may include, for example, a metallic pipe of aluminum. The photoconductive layer may have a structure in which a charge generation layer and a charge transport layer are stacked in order, for example. Being controlled by the controller 7, the photosensitive drum 32 may rotate at a predetermined peripheral velocity in a direction in which the print medium PM is conveyed in the conveyance direction F, i.e., in a direction indicated by an arrow R32.

The charging roller 33 may be a charging member, i.e., a member that electrically charges the surface, i.e., the superficial portion, of the photosensitive drum 32. The charging roller 33 may be in contact with a surface, i.e., a peripheral surface, of the photosensitive drum 32. The charging roller 33 may include, for example, a metallic shaft and an electrically-semiconductive rubber layer. The electrically-semiconductive rubber layer may cover an outer periphery, i.e., the surface, of the metallic shaft. Non-limiting examples of the electrically-semiconductive rubber layer may be an electrically-semiconductive epichlorohydrin rubber layer. Being controlled by the controller 7, the charging roller 33 may rotate in the same direction as that of the photosensitive drum 32, for example.

The exposure head 34 may be an exposure device that forms an electrostatic latent image on the surface, i.e., the superficial portion, of the photosensitive drum 32 by performing exposure on the surface of the photosensitive drum 32. The exposure head 34 may include a plurality of LED portions arranged in the width direction for a single photosensitive drum 32. Each of the LED portions may include, for example but not limited to, a light source and a lens array. The light source may include, for example but not limited to, a light emitting diode that emits irradiation light. The lens array may form an image of the irradiation light on the surface of the photosensitive drum 32.

The developing roller 35 may carry, on its surface, the toner T directed to developing of the electrostatic latent image. The developing roller 35 may be in contact with the surface, i.e., the peripheral surface, of the photosensitive drum 32. The developing roller 35 may include, for example, a metallic shaft and an electrically-semiconductive rubber layer that covers an outer periphery, i.e., the surface, of the metallic shaft. Being controlled by the controller 7, the developing roller 35 may rotate at a predetermined peripheral velocity in a direction opposite to that of the photosensitive drum 32, i.e., in a direction indicated by an arrow R35.

The feeding roller 36 may be a feeding member, i.e., a member directed to feeding of the toner T to the developing roller 35. The feeding roller 36 may be in contact with a surface, i.e., or a peripheral surface, of the developing roller 35. The feeding roller 36 may include, for example, a metallic shaft and a foamable silicone rubber layer that covers an outer periphery, i.e., a surface, of the metallic shaft. Being controlled by the controller 7, the feeding roller 36 may rotate in a direction opposite to that of the developing roller 35, i.e., in a direction indicated by an arrow R36.

The cleaning blade 37 may scrape off remaining of the toner T on the surface of the photosensitive drum 32. The cleaning blade 37 may include, for example, a flexible rubber material or a flexible plastic material.

The waste toner conveying spiral 38 may have a coiled spring shape that is so wound spirally that a wire has a predetermined diameter and a predetermined pitch, for example. Being controlled by the controller 7, the waste toner conveying spiral 38 may rotate in a direction indicated by an arrow R38. The waste toner conveying spiral 38 may rotate and thereby convey in the +X-direction the toner T scraped off by the cleaning blade 37, for example.

The doctor blade 39 may control an amount of the toner T attached to the surface of the developing roller 35.

[Control Mechanism of Image Forming Apparatus]

Figure 6:
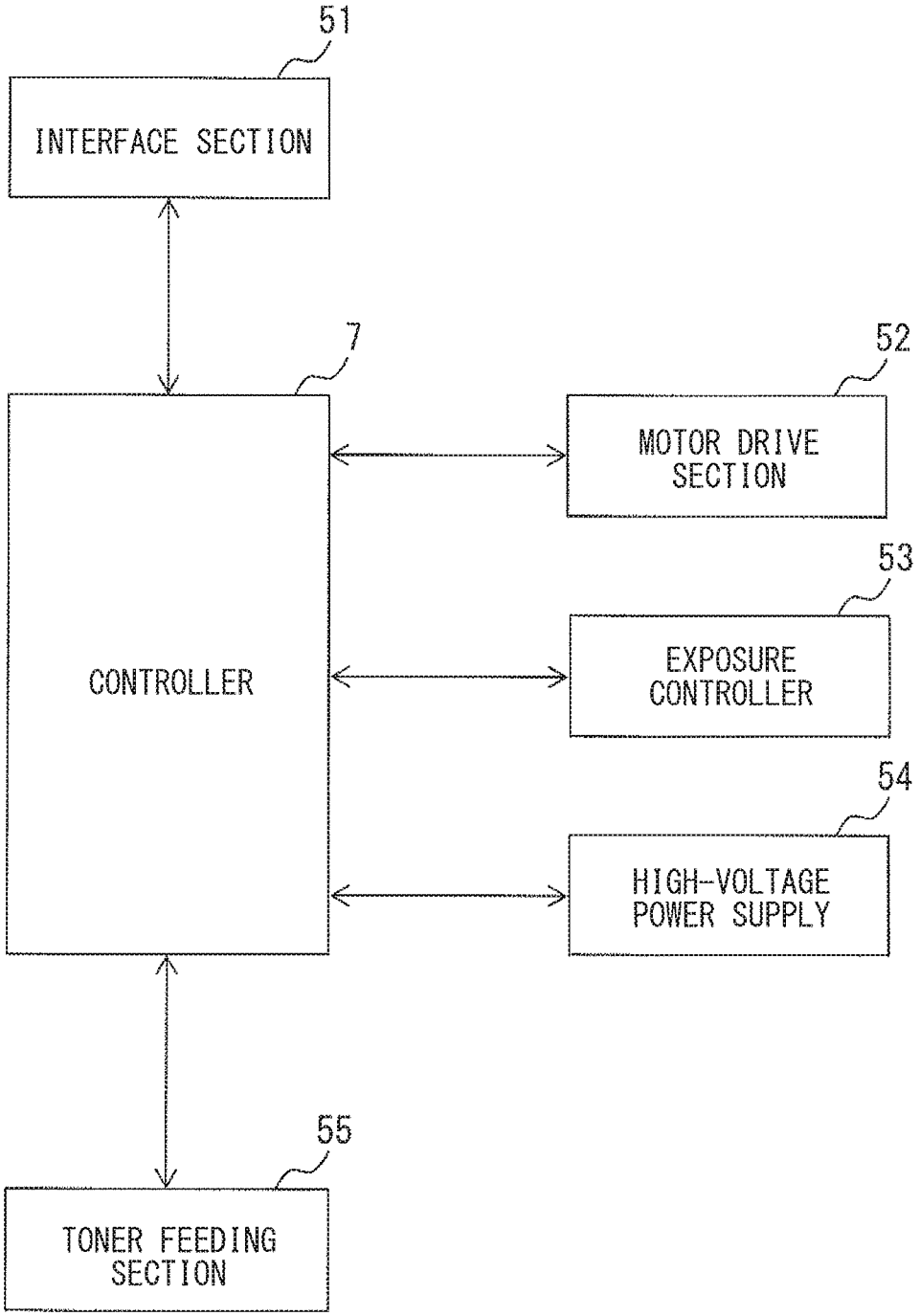
FIG. 6 is a block diagram illustrating an example of a configuration of a control mechanism of an image forming apparatus illustrated in FIG. 1.

FIG. 6 illustrates an example of a control mechanism in the image forming apparatus according to the example embodiment. The image forming apparatus may further include, for example but not limited to, an interface section 51, a motor drive section 52, an exposure controller 53, a high-voltage power supply 54, and a toner feeding section 55 as a control mechanism in addition to the controller 7.

The interface section 51 may receive print data from an external host computer, for example. The interface section 51 may exchange various control signals with the host computer.

The motor drive section 52 may control operation of each motor in the image forming apparatus. The motor drive section 52 may thereby cause each of the print medium feeding section 1, the conveying section 2, the image forming units 30, the transfer section 4, the fixing section 5, and the discharging section 6 to operate, for example.

The exposure controller 53 may control exposure operation of each of the exposure heads 34.

The high-voltage power supply 54 may apply a voltage to each of the charging roller 33, the developing roller 35, the doctor blade 39, the feeding roller 36, of each of the image forming units 30. The high-voltage power supply 54 may also apply a voltage to each of the transfer rollers 4D.

The toner feeding section 55 may feed, to the body portion 301, the toner T contained in the toner cartridge 302.

EXAMPLE WORKINGS AND EXAMPLE EFFECTS

A. Basic Operation

In the image forming apparatus according to the example embodiment, the toner image may be transferred onto the print medium PM as follows.

When print image data and a print command are inputted from an external device to the controller 7 of the activated image forming apparatus, the controller 7 may start printing operation of the print image data on the basis of the print command. Non-limiting examples of the external device may include a personal computer (PC.)

For example, as illustrated in FIG. 1, the print medium PM contained in the tray 1A may be picked up one by one from the top by the pickup roller 1B. The picked-up print medium PM may be fed by the feeding roller 1C toward the conveying section 2 disposed downstream of the feeding roller 1C while its skew being corrected by the feeding roller 1C. Thereafter, the print medium PM may be conveyed by the pair of registration rollers 2A and the pair of registration rollers 2B toward the image forming section 3. The image forming section 3 may transfer the toner image IMG onto the print medium PM as follows.

The image forming section 3 may form the toner image IMG of each color by the following electrophotographic process on the basis of the print command given by the controller 7. In one specific but non-limiting example, the motor drive section 52 illustrated in FIG. 6 may cause the photosensitive drum 32 to rotate at a constant velocity in the directions indicated by the arrow R32 on the basis of the print command given by the controller 7. Accordingly, each of the charging roller 33, the developing roller 35, and the feeding roller 36 may also start rotating in a predetermined direction. The controller 7 may control the amount of the toner T remaining inside the cover 31, on the basis of information supplied from the remaining toner sensor 40. When the amount of the toner T remaining inside the cover 31 is less than a predetermined amount, the toner feeding section 55 illustrated in FIG. 6 may feed the toner T from the toner cartridge 302 to the inside of the body portion 301 via the toner conveyance path 303 on the basis of a command given by the controller 7, until the amount of the remaining toner T reaches a predetermined amount.

The controller 7 may apply a predetermined voltage to the charging roller 33 of each color, and thereby electrically charge the surface of the photosensitive drum 32 of the corresponding color uniformly. Thereafter, the controller 7 may activate the exposure head 34 to cause the photosensitive drum 32 of each color to be irradiated with light corresponding to a color component of the print image based on an image signal. The controller 7 may thereby cause an electrostatic latent image to be formed on the photosensitive drum 32 of each color.

The toner T may be fed to the developing roller 35 via the feeding roller 36. The fed toner T may be carried on the surface of the developing roller 35. The developing roller 35 may attach the toner T to the electrostatic latent image formed on the photosensitive drum 32 and thereby form the toner image IMG Further, a predetermined voltage may be applied to the transfer roller 4D of the transfer section 4. This may generate an electric field between the photosensitive drum 32 and the transfer roller 4D. When the print medium PM passes between the photosensitive drum 32 and the transfer roller 4D in the above-described condition, the toner image IMG formed on the photosensitive drum 32 may be transferred onto the print medium PM.

Thereafter, the toner image IMG on the print medium PM may be applied with heat and pressure by the fixing section 5, and thereby fixed to the print medium PM. Thereafter, the discharging section 6 may discharge the print medium PM with the fixed toner image IMG to the stacker 100A outside the image forming apparatus.

B. Open-Close Operation of Shutter 12

The body portion 301 may be attached at a predetermined position inside the housing 100, for example, by being inserted into the housing 100 of the image forming apparatus in the −X direction. The predetermined position inside the housing 100 may be a position below the toner cartridge 302 and the toner conveyance path 303. At this time, a first protrusion provided inside the housing 100 may engage with the protrusion 121P provided on the upper surface 121US of the flat plate portion 121 of the shutter 12. This may cause the shutter 12 to slide in the second direction Y11B illustrated in FIGS. 4A to 4C with respect to the body 11. Accordingly, attaching of the body portion 301 at the predetermined position inside the housing 100 may cause the shutter 12 to move from the closing position illustrated in FIG. 4B to the open position illustrated in FIG. 4A via the middle position illustrated in FIG. 4C. Since the protrusions 122P and 123P are guided in the second direction Y11B while engaging with the pair of guide grooves 133, the shutter 12 may slide in the second direction Y11B while the inner-surface portions 121B and 121C are kept in close contact with the sealing portion 14. When the shutter 12 is at the open position illustrated in FIG. 4A, the entire input opening 111 may be exposed, and the locking portion 113A of the locking lever 113 may engage with the notch 122K1 of the shutter 12. Engaging of the locking portion 113A of the locking lever 113 with the notch 122K1 may allow the shutter 12 to be stably kept at the open position.

The body portion 301 attached to the housing 100 of the image forming apparatus may be detached from the housing 100 by being pulled out in the +X direction with respect to the housing 100. At this time, a second protrusion provided inside the housing 100 may bias the locking lever 113 downward, i.e., in the −Z-direction, and the spring portion 113B may be thereby displaced. This may disengage the locking portion 113A and the notch 122K1 from each other. Further, a third protrusion provided inside the housing 100 may engage with a portion of the shutter 12, which may cause the shutter 12 to slide in the first direction YHA illustrated in FIGS. 4A to 4C with respect to the body 11. The above-described portion of the shutter 12 may be, for example, the protrusion 121P. Accordingly, the shutter 12 may move from the open position illustrated in FIG. 4A to the closing position illustrated in FIG. 4B via the middle position illustrated in FIG. 4C when the body portion 301 is taken out of the housing 100. Since the protrusions 122P and 123P are guided in the first direction Y11A while engaging with the pair of guide grooves 133, the shutter 12 may slide in the first direction Y11A while the inner-surface portions 121B and 121C are kept in close contact with the sealing portion 14 also in this case. When the shutter 12 is at the closing position illustrated in FIG. 4B, the entire input opening 111 may be closed by the shutter 12, and the locking portion 113A of the locking lever 113 may engage with the notch 122K2 of the shutter 12. Engaging of the locking portion 113A of the locking lever 113 with the notch 122K2 may allow the shutter 12 to be stably kept at the closing position.

Referring to FIGS. 7A to 9C, detailed description is given below of behavior of the toner T upon the position moving of the shutter 12 from the open position to the closing position. When the body portion 301 is taken out of the housing 100 after the printing operation, there is a possibility that the toner T remains in the vicinity of the input opening 111, for example, on the surface of the sealing portion 14, in this image forming apparatus. In one example embodiment, the toner T may be taken into the containing portion 112 and thereby prevented from leaking to the outside of the body 11 in the above-described case. One reason for this is to prevent the toner T from being attached to the outside of the body 11 and thereby prevent the toner T from being scattered to the image forming apparatus and the periphery of the image forming apparatus. It is to be noted that the toner T is illustrated in FIGS. 7A to 9C in a schematic manner in order to facilitate understanding of the behavior of the toner T. Therefore, a size, a shape, number, distribution, etc. of the toner T illustrated in FIGS. 7A to 9C do not necessarily coincide with actual size, shape, number, distribution, etc. It is to be also noted that not all of the toner T present on the body portion 301 is illustrated in FIGS. 7A to 9C.

In a case where the toner T remains on the surface of the sealing portion 14 provided on the flange 13 surrounding the input opening 111, the shutter 12 may allow the toner T to fall through the input opening 111 into the containing portion 112 without leaking to the outside when the shutter 12 moves in the first direction Y11A along the surface of the sealing portion 14.

Figure 7A:
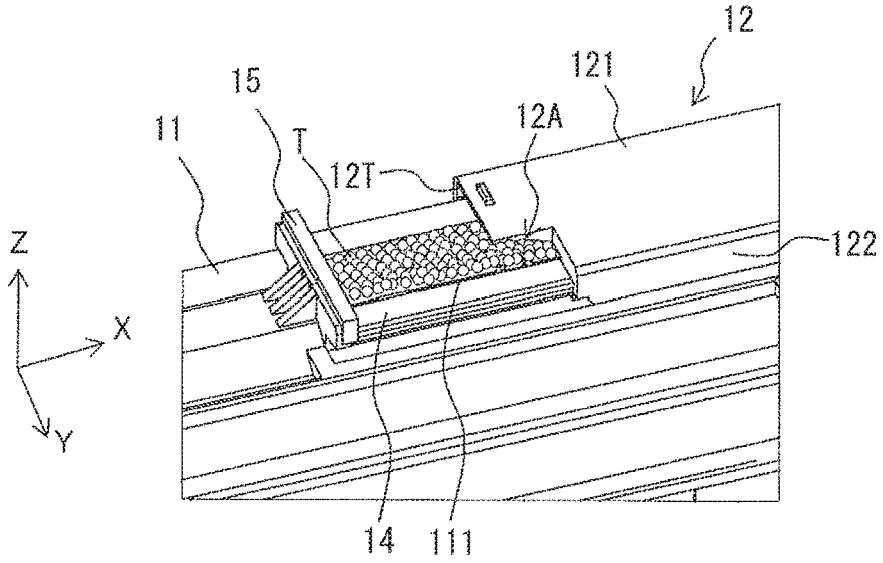
FIG. 7A is a perspective view in an enlarged manner of a main part of the body portion illustrated in FIG. 3 immediately after the shutter starts position moving.
Figure 7B:
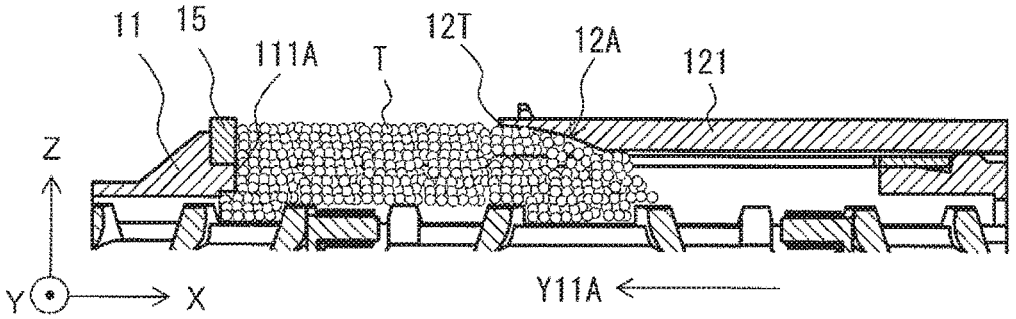
FIG. 7B is a cross-sectional view in an enlarged manner of the main part of the body portion illustrated in FIG. 3 immediately after the shutter starts the position moving.
Figure 7C:
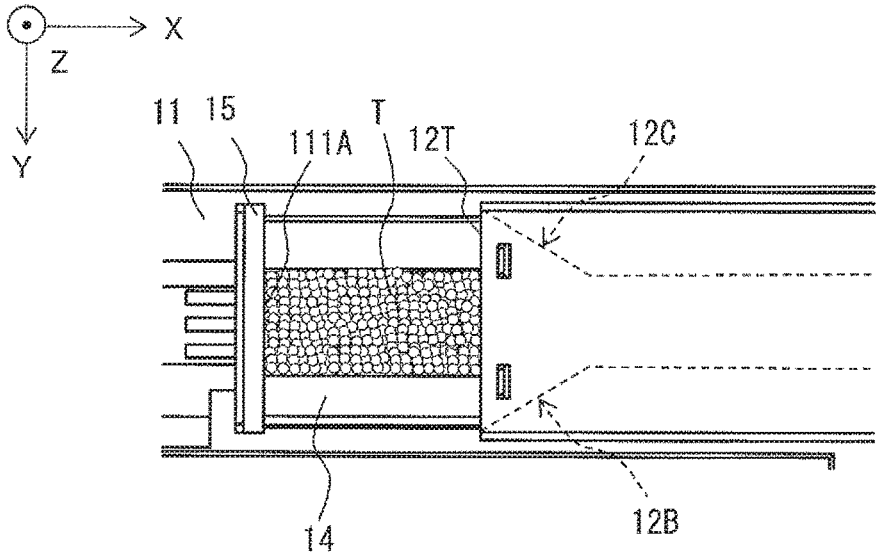
FIG. 7C is a top view in an enlarged manner of the main part of the body portion illustrated in FIG. 3 immediately after the shutter starts position moving.

FIG. 7A is a perspective view in an enlarged manner of the vicinity of the input opening 111 in an early phase which is a phase a predetermined time period after the shutter 12 has started position moving from the open position to the closing position. FIGS. 7B and 7C are respectively a cross-sectional view and a top view in an enlarged manner of the vicinity of the input opening 111 in the early phase.

In the early phase illustrated in FIGS. 7A to 7C, the shutter 12 may cover about half of the input opening 111. The toner T remaining in the vicinity of the input opening 111 may come into contact with the top surface 12A of the tip portion 12S and may be thereby gathered toward the edge 111A, of the input opening 111, in the first direction Y11A. Since the top surface 12A may be inclined with respect to the Y-Z plane that is perpendicular to the first direction Y11A in which the shutter 12 moves, the toner T that has come into contact with the top surface 12A may be so guided along the top surface 12A as to move to space under the flat plate portion 121. The toner T may thereby move toward the inside of the containing portion 112.

Figure 8A:
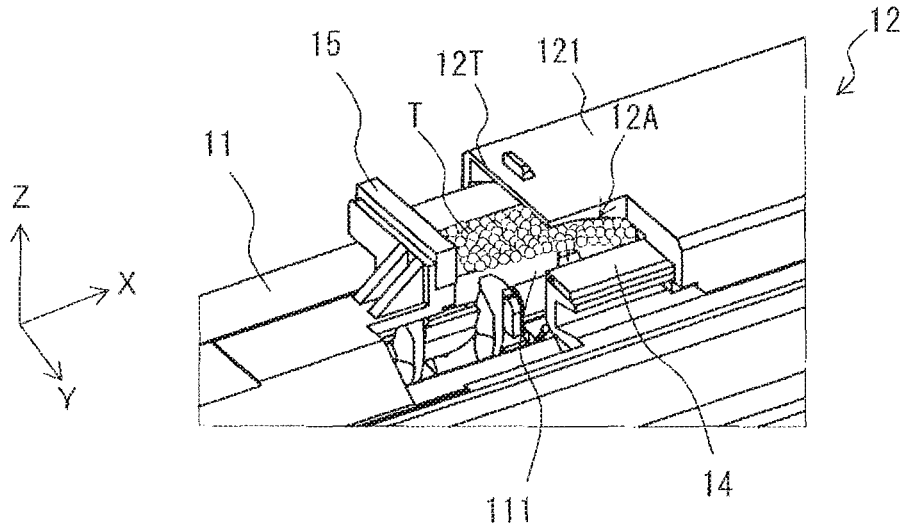
FIG. 8A is a perspective view in an enlarged manner of the main part of the body portion illustrated in FIG. 3 in middle of the position moving of the shutter.
Figure 8B:
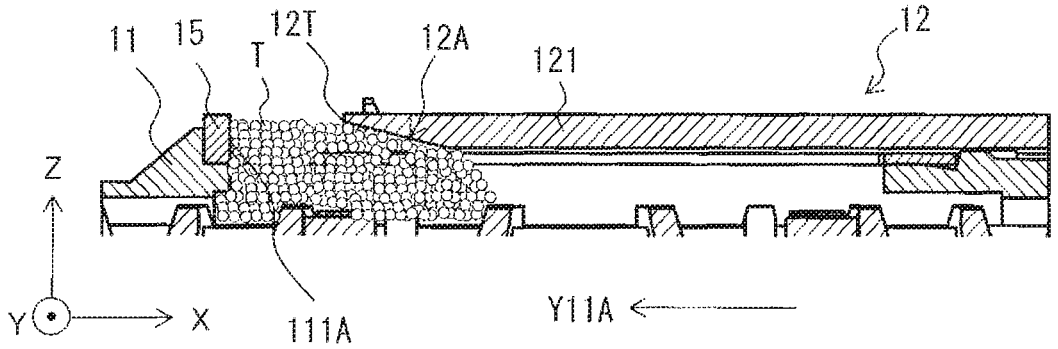
FIG. 8B is a cross-sectional view in an enlarged manner of the main part of the body portion illustrated in FIG. 3 in the middle of the position moving of the shutter.
Figure 8C:
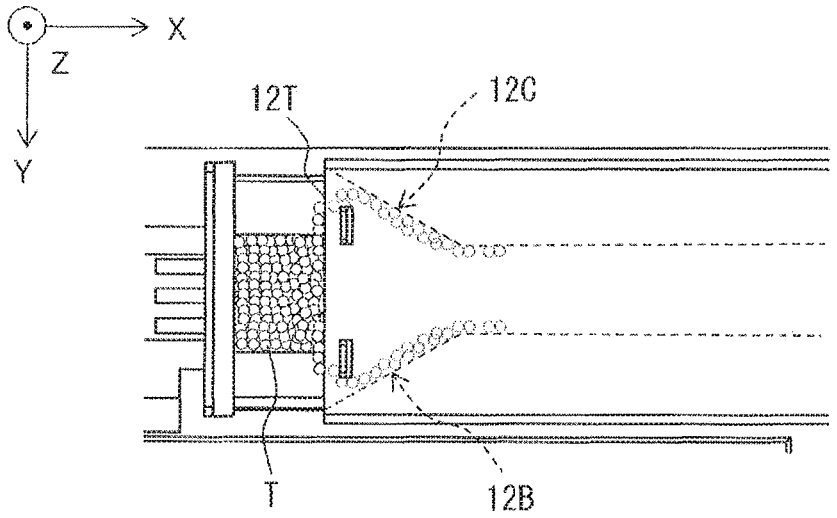
FIG. 8C is a top view in an enlarged manner of the main part of the body portion illustrated in FIG. 3 in the middle of the position moving of the shutter.

FIG. 8A is a perspective view in an enlarged manner of the vicinity of the input opening 111 in a middle phase which is a phase another predetermined time period after the early phase illustrated in FIG. 7A. FIGS. 8B and 8C are respectively a cross-sectional view and a top view in an enlarged manner of the vicinity of the input opening 111 in the middle phase.

In the middle phase illustrated in FIGS. 8A to 8C, the shutter 12 may cover about three quarters of the input opening 111. In this phase, while the toner T in contact with the top surface 12A may be guided along the top surface 12A toward the inside of the containing portion 112, a portion of the toner T gathered toward the edge 111A may so move as to overflow onto the sealing portion 14. As illustrated in FIG. 8C, however, the toner T overflowen onto the sealing portion 14 may come into contact with the pair of side surfaces 12B and 12C. The toner T may be thereby guided toward the center of the input opening 111 in the Y-axis direction, and at the same time, may be guided along the top surface 12A toward the inside of the containing portion 112. Accordingly, the toner T is prevented from overflowing to the outer side of the sealing portion 14.

Figure 9A:
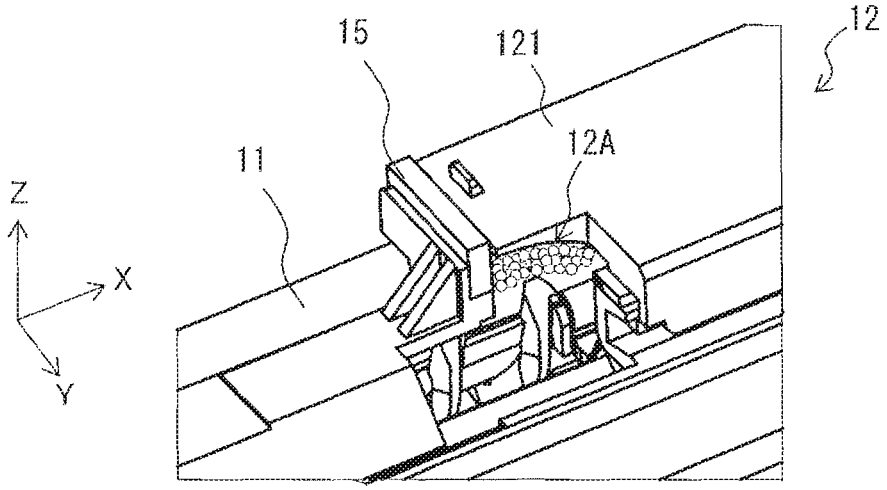
FIG. 9A is a perspective view in an enlarged manner of the main part of the body portion illustrated in FIG. 3 at a time when the shutter completes the position moving.
Figure 9B:
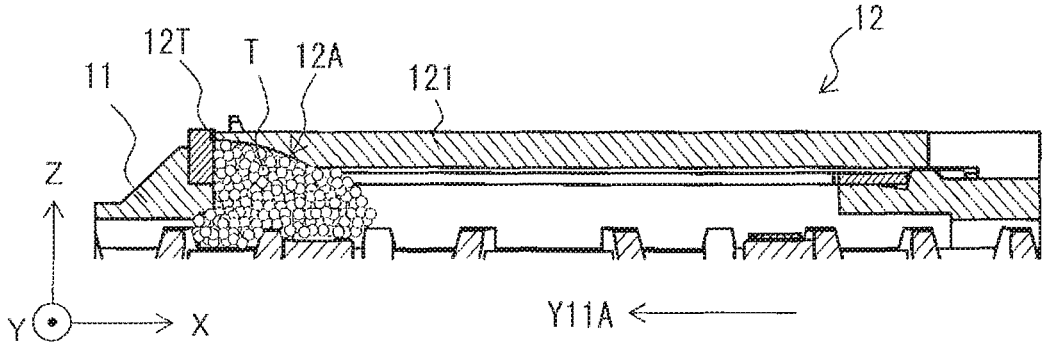
FIG. 9B is a cross-sectional view in an enlarged manner of the main part of the body portion illustrated in FIG. 3 at the time when the shutter completes the position moving.
Figure 9C:
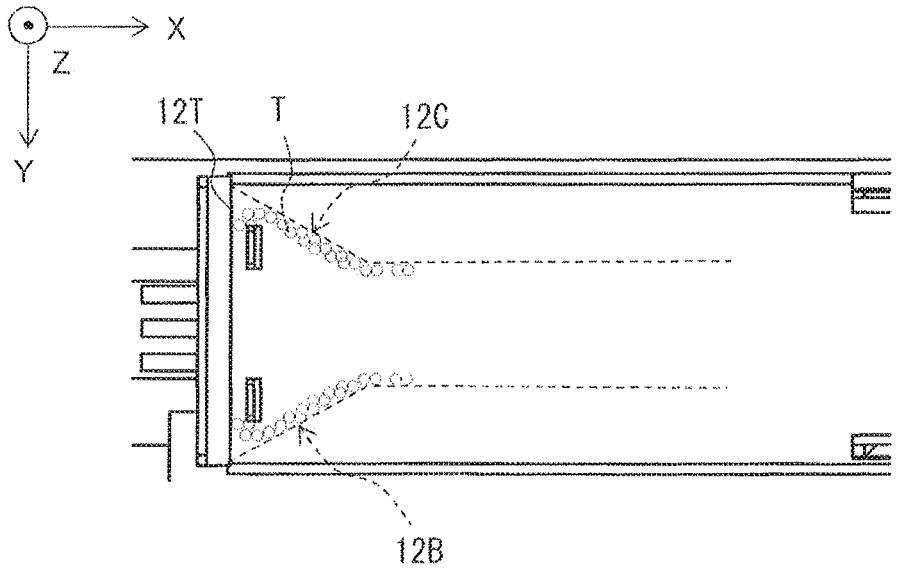
FIG. 9C is a top view in an enlarged manner of the main part of the body portion illustrated in FIG. 3 at the time when the shutter completes the position moving.

FIG. 9A is a perspective view in an enlarged manner of the vicinity of the input opening 111 at a time when the shutter completes the position moving from the open position to the closing position which is a time still another predetermined time period after the middle phase illustrated in FIG. 8A. FIGS. 9B and 9C are respectively a cross-sectional view and a top view in an enlarged manner of the vicinity of the input opening 111 at the time when the shutter 12 completes the position moving.

At the time when the shutter 12 completes the position moving illustrated in FIGS. 9A to 9C, the shutter 12 may cover the entire input opening 111. At this point, all of the toner T may be contained in the inner side of the shutter 12, and the tip surface 12T of the shutter 12 may be in close contact with the sealing portion 15 that stands in the vicinity of the edge 111A.

Next, in order to provide further understanding of a technical advantage of the body portion 301 of the example embodiment, a body portion 1301 having a shutter 1012 and a body 1011 is described as a reference example with reference to FIGS. 10A to 12C, and the behavior of the toner T upon the position moving of the shutter 1012 from the open position to the closing position is described below in detail. As illustrated in FIGS. 10A to 12C, the shutter 1012 has no inclined surface at its tip. Therefore, a thickness of the tip of the shutter 1012, i.e., a dimension in the Z-axis direction, is the same as a thickness of a portion other than the tip of the shutter 1012. That is, the shutter 1012 includes a tip surface 1012T that is parallel to the Y-Z plane perpendicular to a direction in which the shutter 1012 moves, and a dimension of the tip surface 1012T in the Z-axis direction is the same as a thickness of the shutter 1012.

Figure 10A:
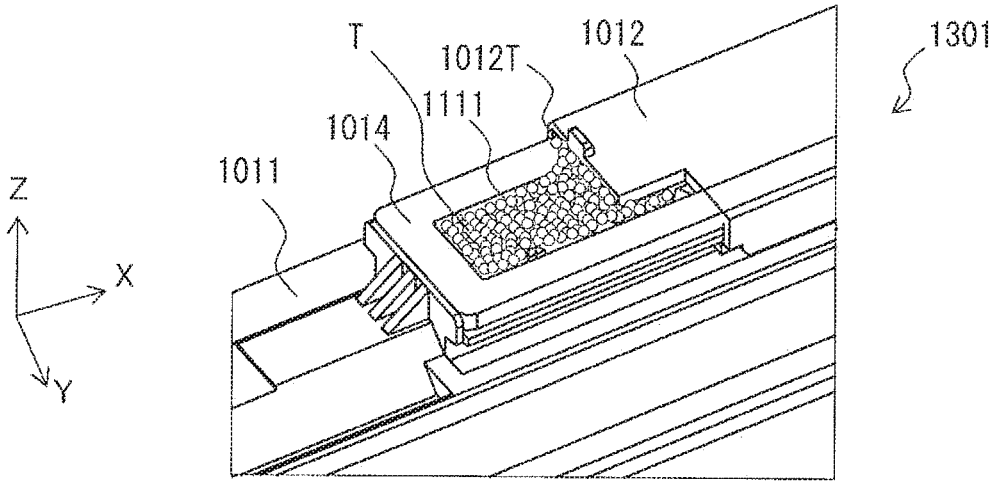
FIG. 10A is a perspective view in an enlarged manner of a main part of a body portion according to a reference example immediately after a shutter starts position moving.
Figure 10B:
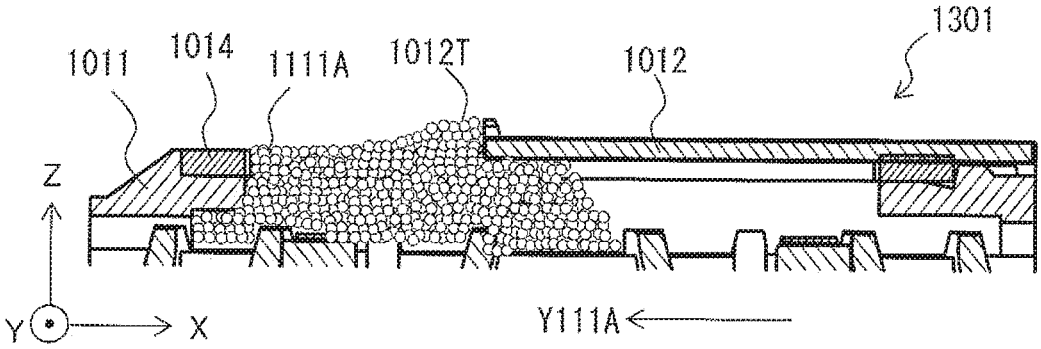
FIG. 10B is a cross-sectional view in an enlarged manner of the main part of the body portion according to the reference example immediately after the shutter starts position moving.
Figure 10C:
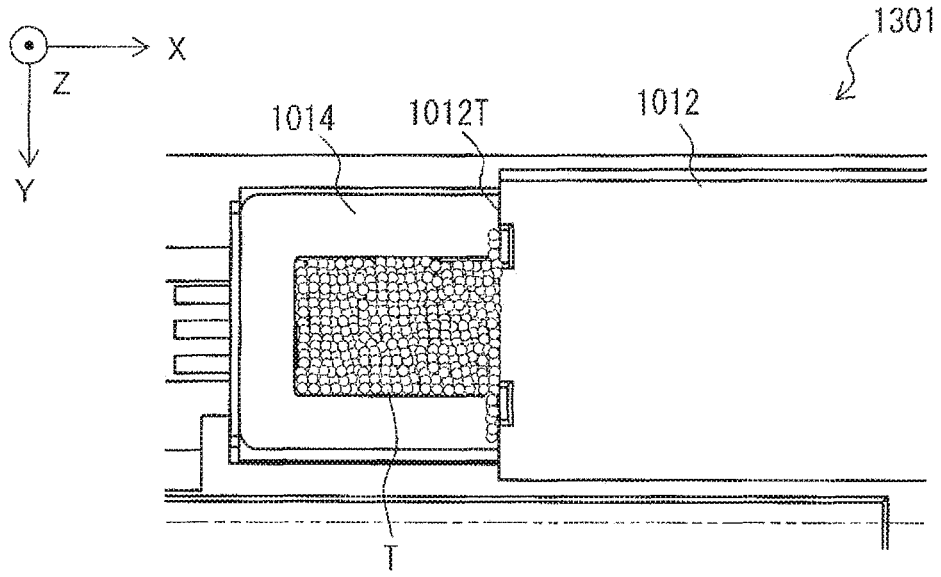
FIG. 10C is a top view in an enlarged manner of the main part of the body portion according to the reference example immediately after the shutter starts position moving.

FIG. 10A corresponding to FIG. 7A is a perspective view in an enlarged manner of the vicinity of the input opening 1111 in an early phase which is a phase a predetermined period after the shutter 1012 has started position moving from the open position to the closing position. FIG. 10B corresponding to FIG. 7B and FIG. 10C corresponding to FIG. 7C are respectively a cross-sectional view and a top view in an enlarged manner of the vicinity of the input opening 111 in the early phase.

In this reference example, the toner T remaining in the vicinity of the input opening 1111 comes into contact with the tip surface 1012T and is gathered toward an edge 1111A illustrated in FIG. 10B of the input opening 1111 in the first direction Y111A already in the early phase. Since the tip surface 1012T is parallel to the Y-Z plane perpendicular to the first direction Y111A in which the shutter 1012 moves, the toner T in contact with the tip surface 1012T moves toward the edge 1111A without moving under the shutter 1012 or moves laterally, i.e., in the Y-axis direction, and overflows onto the sealing portion 1014.

Figure 11A:
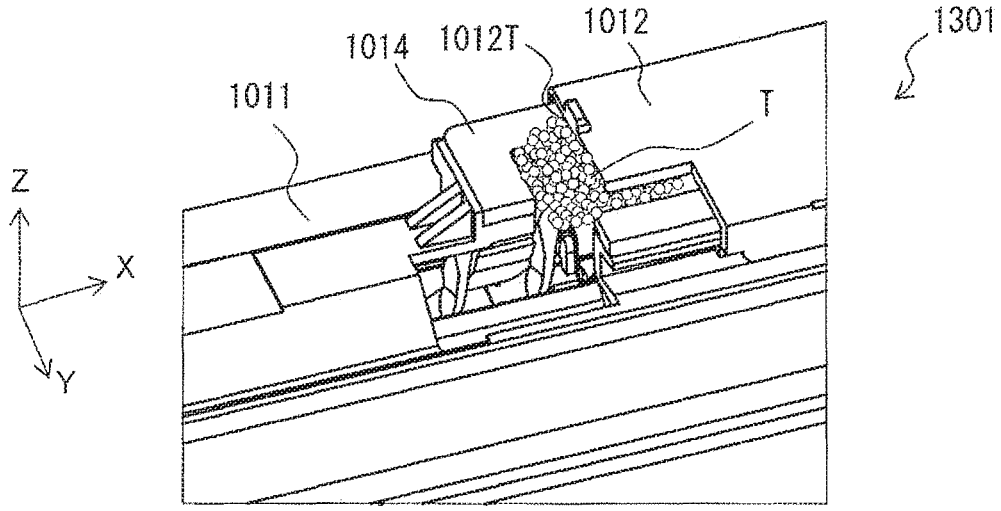
FIG. 11A is a perspective view in an enlarged manner of the main part of the body portion according to the reference example in middle of the position moving of the shutter.
Figure 11B:
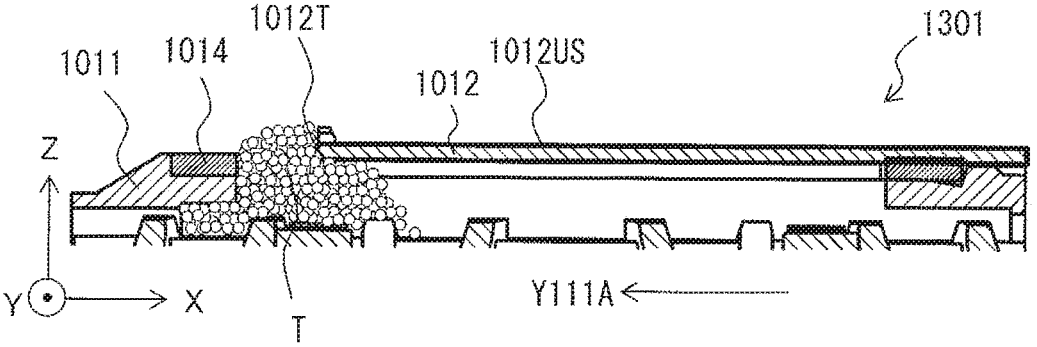
FIG. 11B is a cross-sectional view in an enlarged manner of the main part of the body portion according to the reference example in the middle of the position moving of the shutter.

FIG. 11A corresponding to FIG. 8A is a perspective view in an enlarged manner of the vicinity of the input opening 1111 in a middle phase which is a phase another predetermined time period after the early phase illustrated in FIG. 10A. FIG. 11B corresponding to FIG. 8B and FIG. 11C corresponding to FIG. 8C are respectively a cross-sectional view and a top view in an enlarged manner of the vicinity of the input opening 111 in the middle phase.

Figure 11C:
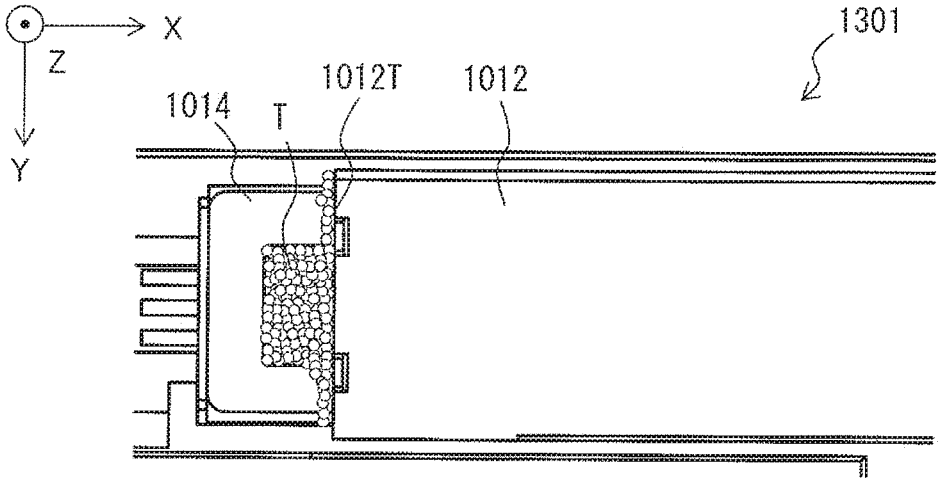
FIG. 11C is a top view in an enlarged manner of the main part of the body portion according to the reference example in the middle of the position moving of the shutter.

In the middle phase illustrated in FIGS. 11A to 11C, the toner T gathered toward the edge 1111A rises up to a position that is higher than a height position of the surface of the sealing portion 1014 and a height position of an upper surface 1012US illustrated in FIG. 11B of the shutter 1012. Therefore, a portion of the toner T moves onto the surface of the sealing portion 1014, and spreads to the outer side of the sealing portion 1014.

Figure 12A:
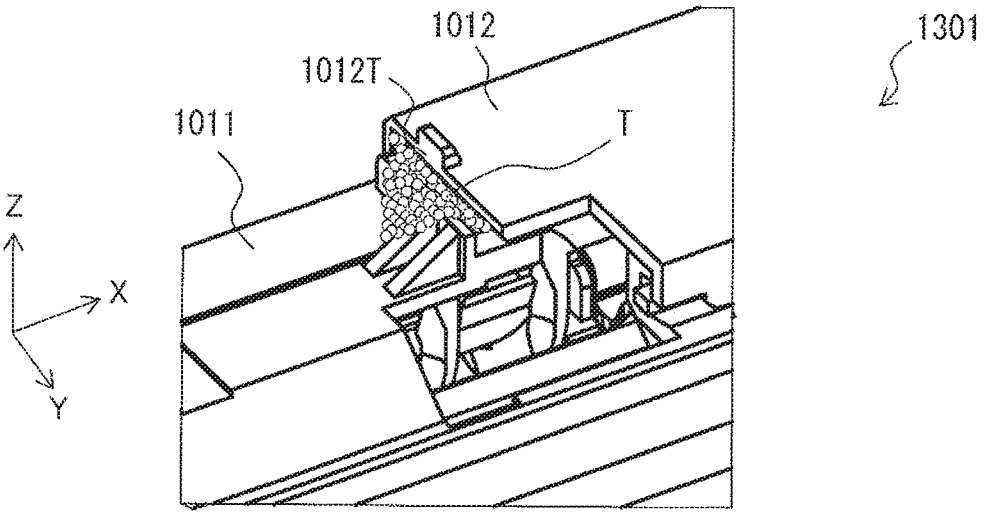
FIG. 12A is a perspective view in an enlarged manner of the main part of the body portion according to the reference example at a time when the shutter completes the position moving.
Figure 12B:
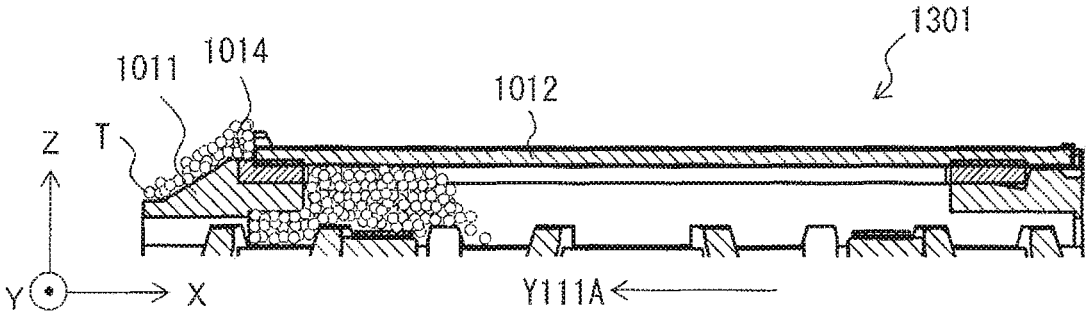
FIG. 12B is a cross-sectional view in an enlarged manner of the main part of the body portion according to the reference example at the time when the shutter completes the position moving.

FIG. 12A corresponding to FIG. 9A is a perspective view in an enlarged manner of the vicinity of the input opening 1111 at the time when the shutter 12 completes the position moving from the open position to the closing position which is a time still another predetermined time period after the middle phase illustrated in FIG. 11A. FIG. 12B corresponding to FIG. 9B and FIG. 12C corresponding to FIG. 9C are respectively a cross-sectional view and a top view in an enlarged manner of the vicinity of the input opening 1111 at the time when the shutter 1012 completes the position moving.

Figure 12C:
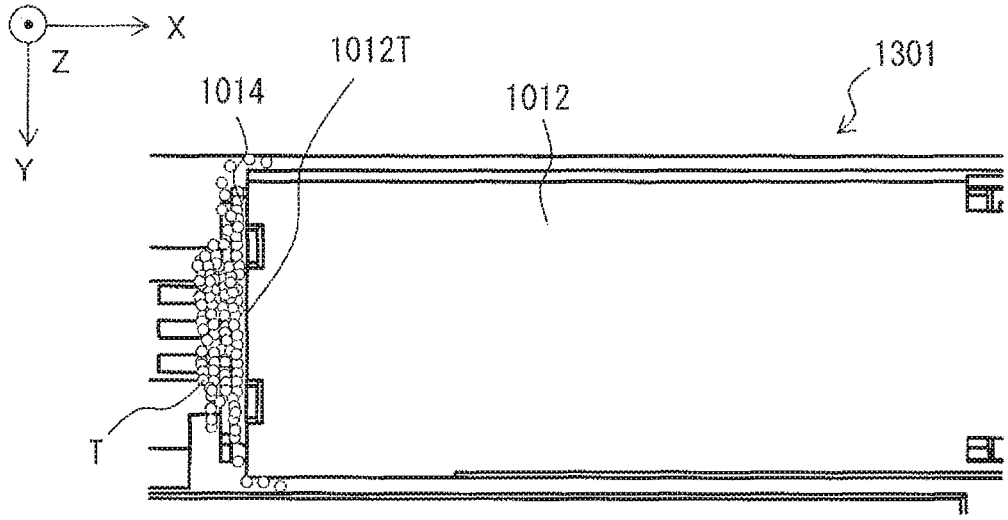
FIG. 12C is a top view in an enlarged manner of the main part of the body portion according to the reference example at the time when the shutter completes the position moving.

At the time when the shutter 1012 completes the position moving illustrated in FIGS. 12A to 12C, the shutter 1012 covers the entire input opening 1111. At this point, however, the toner T that has been pushed by the tip surface 1012T of the shutter 1012 and has overflown beyond the sealing portion 1014 is scattered onto an outer surface of the body 1011.

C. Example Workings and Example Effects

As described above, in the example embodiment, the shutter 12 may include the top surface 12A that is inclined with respect to the Y-Z plane perpendicular to the first direction Y11A, and include the pair of side surfaces 12B and 12C. Accordingly, when the shutter 12 slides in the first direction Y11A and thereby shifts from the open state to the closed state, the toner T present in the vicinity of the input opening 111 is effectively guided to the inside of the containing portion 112 of the body 11. As a result, the toner T is prevented from leaking to the outside of the body portion 301, which makes it possible to ensure superior usability.

In the example embodiment, the sealing portion 15 standing in the vicinity of the edge 111A of the input opening 111 may be provided. This causes the tip surface 12T to be in close contact with the sealing portion 15 when the shutter 12 is in the closed state. Therefore, it is possible to prevent the toner T from leaking to the outside of the body portion 301, for example, from a gap between the inclined top surface 12A and the sealing portion 14.

Further, in the example embodiment, the sealing portion 14 and the sealing portion 15 may be elastic. This sufficiently improves the sealing property between the shutter 12 and the flange 13. It is therefore possible to further prevent the toner T from scattering to the outside of the body portion 301.

Further, in the example embodiment, the height position of the upper end of the sealing portion 15 may be higher than the height position of the upper end of the sealing portion 14. It is therefore possible to effectively prevent the toner T from leaking to the outside of the body portion 301 beyond the sealing portion 15 when the shutter 12 moves from the open position to the closing position.

2. Modification Examples

Although the technology has been described with reference to some example embodiments, the technology is not limited to the example embodiments described above, and is modifiable in a variety of ways. For example, although the example embodiment has been described above with reference to the image forming apparatus that forms a color image, the technology is not limited thereto. In one example embodiment, for example, an image forming apparatus may be provided that transfers only a black toner image and thereby forms a monochrome image. Although the example embodiment has been described above with reference to the image forming apparatus of a primary transfer method, i.e., a direct transfer method, the technology is not limited thereto. One embodiment of the technology is also applicable to a secondary transfer method.

Although the example embodiments and the modification examples thereof have been described above with reference to an image forming apparatus having a printing function as a specific example of the "image forming apparatus" according to one embodiment of the technology, the technology is not limited thereto. One example embodiment of the technology is also applicable to an image forming apparatus that serves as a multifunction peripheral having, for example, a scanning function or a facsimile function in addition to the printing function.

Figure 13:
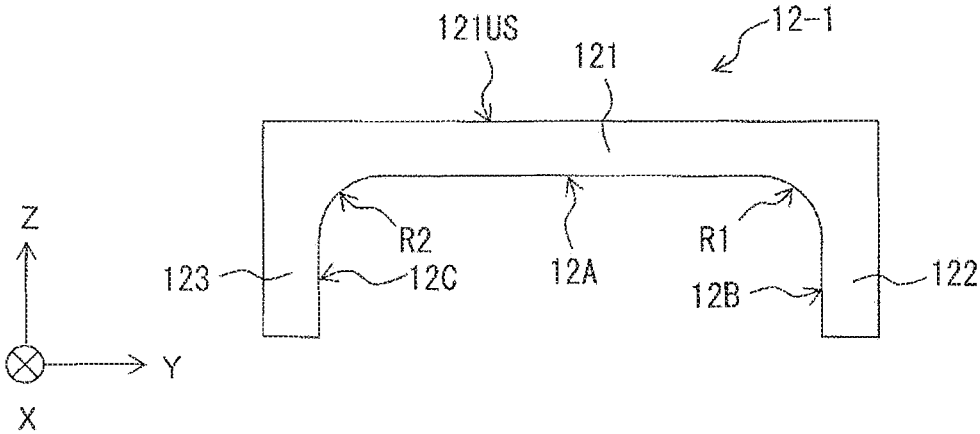
FIG. 13 is a schematic cross-sectional view of a shutter according to a first modification example of the example embodiment of the technology.
Figure 14:
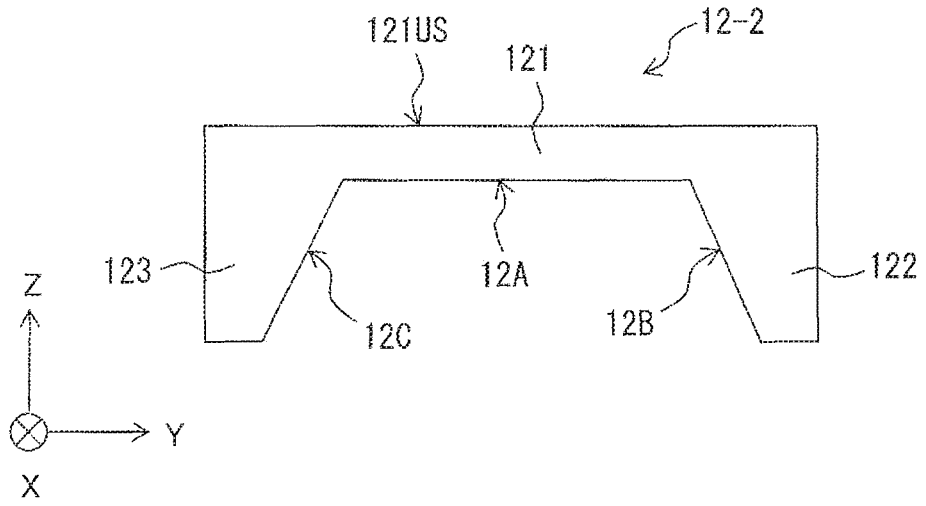
FIG. 14 is a schematic cross-sectional view of a shutter according to a second modification example of the example embodiment of the technology.

The shutter member according to one embodiment of the technology is not limited to the shutter 12 described in the example embodiment above. For example, FIG. 13 illustrates a shutter 12-1 according to a first modification example of the example embodiment of the technology. The shutter 12-1 may include a curved surface R1 provided between the top surface 12A and the side surface 12B, and a curved surface R2 provided between the top surface 12A and the side surface 12C. For example, FIG. 14 illustrates a shutter 12-2 according to a second modification example of the example embodiment of the technology. The shutter 12-2 may include the side surfaces 12B and 12C that are inclined with respect to the Z-axis direction, i.e., the vertical direction. It is to be noted that FIGS. 13 and 14 are respectively cross-sectional views of the shutter 12-1 and the shutter 12-2 corresponding to the cross-section of the shutter 12 illustrated in FIG. 5E and described in the example embodiment above.

In one example embodiment of the technology, the shutter member may include the inclined top surface only in a portion of the shutter member in the width direction, i.e., the Y-axis direction, perpendicular to the first direction and the third direction.

Figure 15A:
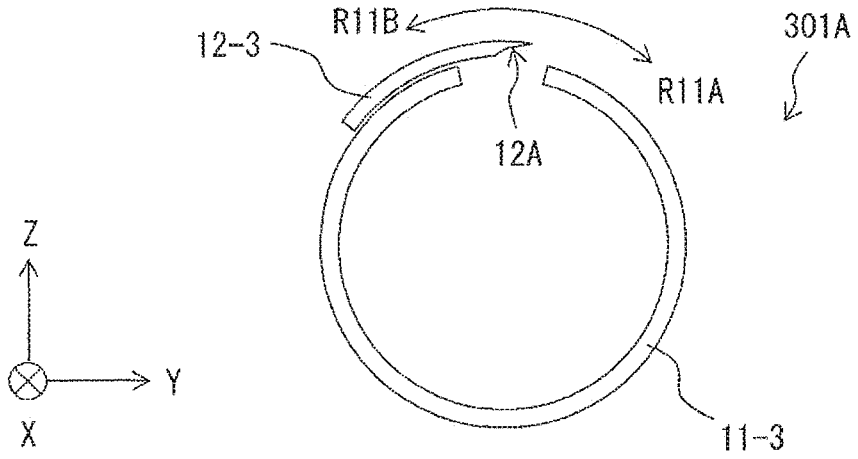
FIG. 15A is a schematic cross-sectional view of a body portion according to a third modification example of the example embodiment of the technology.
Figure 15B:
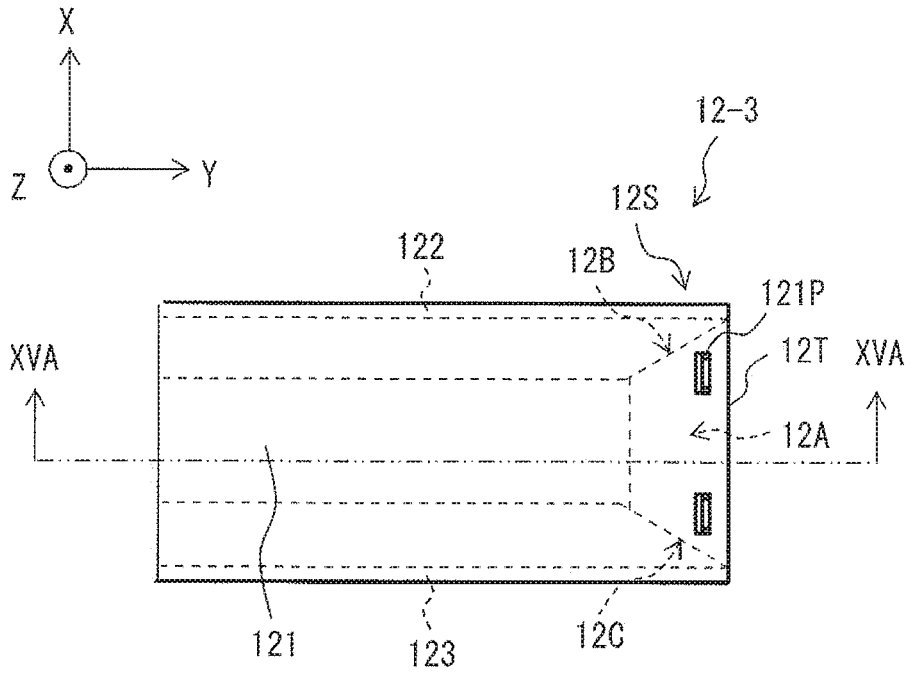
FIG. 15B is a schematic top view of a configuration of a shutter in the body portion according to the third modification example illustrated in FIG. 15A.

Further, the shutter member according to one embodiment of the technology is not limited to that sliding in a straight-line direction. FIG. 15A illustrates a body portion 301A according to a third modification example of the example embodiment of the technology. The developer container according to one embodiment of the technology may include, as with the body portion 301A illustrated in FIG. 15A, a body 11-3 that has a cylindrical shape and a shutter 12-3 that has a curved shape to be a portion of the cylindrical shape, for example. The shutter 12-3 of the body portion 301A may slide in a direction along a shape of the outer peripheral surface of the cylindrical body 11-3. In the body portion 301A, the shutter 12-3 may moves from the open position to the closing position by sliding in a first direction R11A with respect to the body 11-3, and the shutter 12-3 may move from the closing position to the open position by the sliding in a second direction R11B with respect to the body 11-3. As illustrated in FIG. 15B, the shutter 12-3 may have the top surface 12A and the pair of side surfaces 12B and 12C, as with the shutter 12 described in the example embodiment above. In other words, the shutter 12-3 may include the inclined top surface 12A and the pair of side surfaces 12B, 12C at the tip portion 12S in the direction in which the shutter 12-3 moves when the shutter 12-3 moves from the open position to the closing position.

Furthermore, the technology encompasses any possible combination of some or all of the various embodiments and the modifications described herein and incorporated herein. It is possible to achieve at least the following configurations from the above-described example embodiments of the technology.

(1)

A developer container including:

a body having an opening and a containing part, the containing part being to contain a developer put into the containing part through the opening; and a shutter member including a tip portion at a tip of the shutter member in a first direction, the shutter member being slidable between a closing position at which the shutter member closes the opening and an open position at which the shutter member leaves the opening open, the shutter member sliding in the first direction and thereby moving from the open position to the closing position, the tip portion including a top surface having inclination, the top surface having a distance in a third direction from the opening to the top surface, the inclination causing the distance to decrease in a second direction, the second direction being opposite to the first direction, the third direction being a direction from outer side of the body toward inner side of the body, and a pair of side surfaces, spacing in a fourth direction between the pair of side surfaces being narrowed in the second direction, the fourth direction being substantially perpendicular to each of the first direction and the third direction.

(2)

The developer container according to (1), further including an elastic member that is disposed on an outer surface of the body and surrounds the opening, wherein the shutter member slides in the first direction with the elastic member being compressed by the shutter member.

(3)

The developer container according to (1), further including a contact portion that is provided in vicinity of an edge, the edge being an edge of the opening in the first direction, the contact portion coming into contact with a tip surface of the tip portion of the shutter member when the shutter member is in the closed state.

(4)

The developer container according to (3), in which the contact portion is elastic.

(5)

The developer container according to any one of (1) to (4), in which the top surface includes a recessed surface.

(6)

An image forming unit including the developer container according to any one of (1) to (5).

(7)

An image forming apparatus including the developer container according to any one of (1) to (5).

(8)

The image forming apparatus according to (7), in which the opening of the developer container is directed upward in a gravitational direction.

In each of the developer container, the image forming unit, and the image forming apparatus according to one embodiment of the technology, the shutter member includes the top surface and the pair of side surfaces. The top surface is inclined with respect to a plane perpendicular to the first direction. Accordingly, the developer present in the vicinity of the opening is guided to the inside of the body when the shutter member slides in the first direction and thereby shifts from the open state to the closed state.

According to each of the developer container, the image forming unit, and the image forming apparatus of one embodiment of the technology, it is possible to prevent the developer from leaking to outside and thereby achieve superior usability.

Although the technology has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. The term "substantially" and its variations are defined as being largely but not necessarily wholly what is specified as understood by one of ordinary skill in the art. The term "about" or "approximately" as used herein can allow for a degree of variability in a value or range. Moreover, no element or component in this disclosure is intended to be dedicated to the public regardless of whether the element or component is explicitly recited in the following claims.

What is claimed is:

1. A developer container comprising:

a body having an opening and a containing part, the containing part being to contain a developer put into the containing part through the opening; and a shutter member including a tip portion at a tip of the shutter member in a first direction, the shutter member being slidable between a closing position at which the shutter member closes the opening and an open position at which the shutter member leaves the opening open, the shutter member sliding in the first direction and thereby moving from the open position to the closing position, the tip portion including an opposing surface opposed to the opening at the closing position of the shutter member, and inclined to be away from the opening in the first direction, and a pair of side surfaces having a spacing therebetween in a width direction, the pair of side surfaces being substantially orthogonal to a surface having the opening, the width direction being parallel to the surface having the opening and being orthogonal to the first direction, the spacing increasing in the first direction.

2. The developer container according to claim 1, further comprising an elastic member that is disposed on an outer surface of the body and surrounds the opening, wherein the shutter member slides in the first direction with the elastic member being compressed by the shutter member.

3. The developer container according to claim 1, further comprising a contact portion that is provided in a vicinity of an edge, the edge being an edge of the opening in the first direction, the contact portion coming into contact with a tip surface of the tip portion of the shutter member when the shutter member is in the closed state.

4. The developer container according to claim 3, wherein the contact portion is elastic.

5. The developer container according to claim 1, wherein the opposing surface comprises a recessed surface.

6. An image forming unit comprising the developer container according to claim 1.

7. An image forming apparatus comprising the developer container according to claim 1.

8. The image forming apparatus according to claim 7, wherein the opening of the developer container is directed upward in a gravitational direction.

* * * * *